US007867091B2

(12) United States Patent
Moshal

(10) Patent No.: US 7,867,091 B2
(45) Date of Patent: Jan. 11, 2011

(54) MULTIPLAYER GAMING SYSTEM AND METHOD OF OPERATION THEREOF

(75) Inventor: Martin Moshal, Gibraltar (GB)

(73) Assignee: Waterleaf Limited, Isle of Man (GB)

( * ) Notice: Subject to any disclaimer, the term of this patent is extended or adjusted under 35 U.S.C. 154(b) by 810 days.

(21) Appl. No.: 10/545,213

(22) PCT Filed: Sep. 30, 2004

(86) PCT No.: PCT/IB2004/003179

§ 371 (c)(1),
(2), (4) Date: Aug. 11, 2005

(87) PCT Pub. No.: WO2005/033825

PCT Pub. Date: Apr. 14, 2005

(65) Prior Publication Data

US 2006/0084499 A1 Apr. 20, 2006

(30) Foreign Application Priority Data

Oct. 2, 2003 (GB) ..... 0323072.9
Oct. 30, 2003 (GB) ..... 0325312.7

(51) Int. Cl.
*A63F 9/24* (2006.01)

(52) U.S. Cl. ..... 463/40; 463/42

(58) Field of Classification Search ..... 463/16, 463/20, 25, 31, 40–42, 37; 273/292
See application file for complete search history.

(56) References Cited

U.S. PATENT DOCUMENTS 4,836,553 A 6/1989 Suttle et al. ..... 273/292

(Continued)

FOREIGN PATENT DOCUMENTS

CA 2415274 12/2002
WO WO03093921 11/2003

OTHER PUBLICATIONS

Supplementary European Search Report in EP 04 78 7542, dated Nov. 7, 2007.

*Primary Examiner*—Peter DungBa Vo
*Assistant Examiner*—Masud Ahmed
(74) *Attorney, Agent, or Firm*—McDonnell Boehnen Hulbert & Berghoff LLP

(57) ABSTRACT

A multiplayer gaming system that is usable by a number of participating players to play a multiplayer game, comprises a plurality of player stations, each player station enabling a respective participating player to place a wager on an outcome of the multiplayer game and to play a separate instance of a same single-player game having a plurality of possible results, and an application web server communicable with each one of the plurality of player stations.

The application web server is operable to determine an outcome of the multiplayer game as a function of the combined results of the separate instances of the single-player game played at the plurality of player stations. The outcome of the multiplayer game is either a favourable outcome if one or more participating players are determined by the application web server as being a winner of the multiplayer game, or an unfavourable outcome in which none of the participating players is determined as being a winner.

A single turn of the multiplayer game includes at least one turn of an instance of the single-player game at each one of the plurality of player stations in use by a participating player. The application web server determines an outcome of a turn of the multiplayer game only after completion of at least one turn of an instance of the single-player game for each participating player, respectively, and awards a prize to the winning player when the outcome of the turn of the multiplayer game is a favourable outcome.

60 Claims, 13 Drawing Sheets

U.S. PATENT DOCUMENTS

| | | | | |
|---|---|---|---|---|
| 5,374,067 | A | 12/1994 | Jones | 273/292 |
| 5,380,012 | A | 1/1995 | Jones et al. | 273/292 |
| 5,382,025 | A | 1/1995 | Sklansky | 273/292 |
| 5,395,120 | A | 3/1995 | Malek | 273/292 |
| 5,397,133 | A | 3/1995 | Penzias | 463/22 |
| 5,476,259 | A * | 12/1995 | Weingardt | 463/28 |
| 5,564,700 | A | 10/1996 | Celona | 463/27 |
| 5,586,937 | A | 12/1996 | Menashel | 463/41 |
| 5,935,002 | A | 8/1999 | Falciglia | 463/19 |
| 5,971,397 | A | 10/1999 | Miguel et al. | 273/371 |
| 5,971,849 | A | 10/1999 | Falciglia | 463/16 |
| 6,007,066 | A | 12/1999 | Moody | 273/292 |
| 6,012,720 | A | 1/2000 | Webb | 273/292 |
| 6,089,980 | A | 7/2000 | Gauselmann | 463/27 |
| 6,237,916 | B1 | 5/2001 | Webb | 273/292 |
| 6,264,560 | B1 * | 7/2001 | Goldberg et al. | 463/42 |
| 6,345,823 | B1 | 2/2002 | Webb | 273/292 |
| 6,416,411 | B1 | 7/2002 | Tsukahara et al. | 463/35 |
| 6,511,068 | B1 | 1/2003 | Sklansky et al. | 273/237 |
| 6,652,378 | B2 | 11/2003 | Cannon et al. | 463/20 |
| 6,679,777 | B2 | 1/2004 | Pfeiffer et al. | 463/42 |
| 6,755,741 | B1 | 6/2004 | Rafaeli et al. | 463/25 |
| 6,860,810 | B2 | 3/2005 | Cannon et al. | 463/20 |
| 6,887,157 | B2 | 5/2005 | LeMay et al. | 463/32 |
| 6,999,083 | B2 | 2/2006 | Wong et al. | 345/473 |
| 7,094,154 | B2 | 8/2006 | Kellerman et al. | 463/42 |
| 7,192,351 | B2 | 3/2007 | Rozkin et al. | 463/40 |
| 2002/0028707 | A1 | 3/2002 | Pascal et al. | 463/42 |
| 2002/0052229 | A1 | 5/2002 | Halliburton et al. | 463/9 |
| 2003/0130041 | A1 | 7/2003 | Pascal et al. | 463/42 |
| 2004/0023722 | A1 | 2/2004 | Vuong et al. | 463/40 |
| 2004/0152508 | A1 * | 8/2004 | Lind et al. | 463/19 |
| 2004/0192442 | A1 * | 9/2004 | Wells et al. | 463/36 |
| 2004/0204213 | A1 * | 10/2004 | Schugar et al. | 463/6 |
| 2004/0204246 | A1 | 10/2004 | Halliburton et al. | 463/42 |
| 2004/0256803 | A1 * | 12/2004 | Ko | 273/292 |
| 2005/0043094 | A1 * | 2/2005 | Nguyen et al. | 463/42 |
| 2007/0191109 | A1 | 8/2007 | Crowder et al. | 463/42 |

* cited by examiner

"Pot Slot" Variation"

"Pot Slot With Community Feature" Variation"

"Community Slot – Even Distribution" Variation"

"Community Slot – 50/Pooled" Variation"

MULTIPLAYER GAMING SYSTEM AND METHOD OF OPERATION THEREOF

Pursuant to 35 U.S.C. §365, priority is claimed to PCT/IB2004/003179 filed Sep. 30, 2004, and to the prior British applications GB 0323072.9 filed Oct. 2, 2003 and GB 0325312.7 filed Oct. 30, 2003.

FIELD OF THE INVENTION

This invention relates to a multiplayer gaming system for playing a game, more specifically, a multiplayer game and, more particularly, to a multiplayer gaming system for playing a multiplayer game on which wagers may be placed. The invention extends to a method of operation of a multiplayer gaming system for playing a multiplayer game on which wagers may be placed.

BACKGROUND OF THE INVENTION

The game of poker is a multiplayer game that is widely played in many jurisdictions, particularly in the United States of America. In order to illustrate various advantageous features of multiplayer games, the basic rules of poker will be outlined briefly in the description that follows.

A traditional game of poker generally accommodates a minimum of 4 and a maximum of between 8 and 10 players. In a turn of the game, one of the participating players assumes the role of a dealer and deals five cards (an "initial hand"), from a conventional deck of 52 playing cards, to each participating player, inclusive of the dealer. The playing cards in the initial hand are dealt face down to each player who does not, at this stage of the game, disclose the playing cards that have been dealt to him.

Each one of the players is then required to decide, in turn, whether to continue with his participation in the turn of the game (that is, to "play"), or to terminate his participation in the turn (that is, to "fold"), as a function of the playing cards in his initial hand. Any player who decides to fold does not participate any longer in the turn of the game. If all participating players decide to fold, the turn of the game terminates. The first player to decide to play is required to make an opening wager on the turn of the game. Any other player who subsequently also decides to play in the turn of the game is required to match or to increase ("raise") the size of the opening wager. When the size of the opening wager is raised, players who have made prior opening wagers are required to top up their wagers to match the size of the largest opening wager made by any player who has elected to play in the turn of the game. This phase of the turn of the game continues until every player who desires to play in that turn has made an equivalent opening, wager.

All the wagers made by each of the players are accumulated in a single jackpot ("the pot").

At this stage of the game, each player who has decided to play may, in turn, then decide to retain (that is, to "hold") any number of the cards in his initial hand. Once a player has decided which, if any, of the five cards to hold, the player may then "draw", in which the remaining cards of the initial hand are discarded and are replaced by an equivalent number of further cards dealt by the dealer from the deck of playing cards. This phase of the game will be referred to, for convenience, as the drawing phase. If the player does not hold any of the cards, in his initial hand, he is then effectively dealt an entirely new hand of five cards at the drawing phase of the game. On the other hand, if a particular player holds all of the five cards in his initial hand, he does not participate in the drawing phase, but still continues to play in the turn of the game.

Once the drawing phase of the game has been completed, each player evaluates the five cards he has accumulated in the manner described above in order to determine whether they contain any one of a number of desirable combinations of playing cards. The desirability of any combination of playing cards is inversely proportional to the probability of being dealt that particular combination of cards.

After completion of the drawing phase of a turn of the game and evaluation of the playing cards, all of the players who have previously decided to play in the particular turn of the game are then again required to decide, in turn, as a function of the playing cards they have accumulated in the manner described above, whether to continue playing or to fold. Any player who decides to fold does not participate any further in the particular turn of the game and forfeits all wagers he has made in that turn. The first player who makes an opening wager may, if he decides to play, make a supplementary wager on the turn of the game. Any other player who also decides to play is required to match or to raise the size of the supplementary wager. Players who have previously made supplementary wagers are required to top up their supplementary wagers to match the size of the largest supplementary wager. This phase of the particular turn of the game continues until every player who has not folded has made an equivalent supplementary wager. This stage of the game will be referred to, for convenience, as the supplementary wagering stage.

The supplementary wagers made by each of the players who have decided to continue playing in the particular turn of the game are added to the pot.

Once the supplementary wagering stage of the turn of the game has been completed, the players who remain in the game reveal the playing cards in their hands. The hands are compared, and the player with the highest-ranking desirable hand wins the accumulated pot.

The rules of the game of poker have been described with particular reference to a variation of the game known as "draw poker". There are many other variations of the game of poker that are not germane to the essence of the invention and that will not, for this reason, be described here in detail.

It will be appreciated by those skilled in that art that the game of poker is a zero-sum game insofar as, in each turn of the game, a gain of the winner is equal to accumulated losses of the other players in the game. It is, however, also known for a party who arranges or hosts a game of poker to levy a commission ("a rake") on the players or on the accumulated jackpot in order to obtain revenue.

The game of poker is played at both land-based venues and on-line, in the latter instance by means of the Internet. Where the game is played on-line, a software program spawns multiple instances of the game, each instance being known as a "poker room", to accommodate players wishing to participate in the game. Thus, any instance of the game, or poker room, accommodates participating players who may be geographically remote from each other. The software program offers the participating players with various artifices such as, for example, a chat facility, which allow the players to interact with each other, thereby establishing a sense of community such as would be found at a game being played at a land-based venue.

The game of slots is probably the most popular and widely played single-player casino game available to players. The most common game of slots is found in a simple three-reel slot machine. Each reel of the slot machine has, say, 30 indexed positions, some or all of which may display a corresponding indicium. A player of the slot machine is required to place a wager on an outcome of the casino game by introducing coins, tokens or credit into the slot machine, which then enables each of the three reels to be spun and to come to rest at any of the indexed positions. An outcome of the game is determined as a function of a combination of the three resulting indexed rest positions. Several outcomes of the game usually result in the player being awarded corresponding prizes, one particular outcome causing the player to win a jackpot prize. A slot machine with the particular characteristics described above has a jackpot cycle of 27 000, which means that, on average, 27 000 outcomes of the game must be determined in order for the jackpot to be won by the player.

The three reel slot machine described above may be a free-standing electro-mechanical or electronic machine suitable for use in a land-based venue, or may, alternatively, be an on-line implementation, where the three reels of the slot machine are simulated on a display monitor, while an outcome of the game is derived from a random number generator implemented in software. It will be appreciated that the game of slots is a single-player game, unlike the game of poker described above. Although banks of slot machines may be found in land-based casinos, each player at such a bank of machines is playing the game individually for himself. An advantage of such single-player games is that of rapid play and the immediacy of a result in a turn of a game.

It is desirable to combine the immediacy of a single-player casino game with the community aspects that are obtainable in a multiplayer poker game.

OBJECT OF THE INVENTION

It is an object of this invention to provide a multiplayer gaming system and a method of operation thereof that will, at least partially, enable a single-player game to be played in a multi player environment.

SUMMARY OF THE INVENTION

In accordance with this invention there is provided a multiplayer gaming system usable by a number of participating players to play a multiplayer game, comprising:

a plurality of player stations, each player station being usable by a respective participating player to play a separate instance of a same single-player game having a plurality of possible results, the player station enabling the participating player to place a wager on an outcome of the multiplayer game; and an administration facility communicable with each one of the plurality of player stations characterised in that the administration facility is operable to determine an outcome of the multiplayer game as a function of the combined results of the separate instances of the single-player game played at the plurality of player stations, the outcome of the multiplayer game being either a favourable outcome if at least one participating player is determined by the administration facility as being a winner of the multiplayer game, or an unfavourable outcome in which none of the participating players is determined as being a winner.

Further features of the invention provide for a single turn of the multiplayer game to comprise at least one turn of the single-player game in each separate instance of the single-player game played a player station in use by a participating player, for the administration facility to determine an outcome of the turn of the multiplayer game only after completion of the at least one turn of the single-player game in each separate instance of the single-player game for each participating player, respectively, for the administration facility to award a prize to the at least one winning player when the outcome of the turn of the multiplayer game is a favourable outcome, for the administration facility to accumulate, in each separate turn of the multiplayer game, all wagers by the participating players in an accumulation account, for the administration facility to establish a prize pool whose contents are a function of the outcomes of the separate instances of the single-player game played at the plurality of player stations, for the prize awarded to the at least one winning player to be one of the contents of the accumulation account, preferably the contents of the accumulation account less a service fee retained by an operator of the multiplayer gaming system, or the contents of the prize pool, the contents of the accumulation account being retained by the operator of the gaming system to fund the prize pool, and for the contents of either of the accumulation account and the prize pool to be shared when the accumulation facility determines a plurality of winners in the turn of the multiplayer game.

Still further features of the invention provide for any instance of the single-player game to have a plurality of successful results, the plurality of successful results being in ranked order, from least successful to most successful, for the administration facility to determine the at least one winner of a turn of the multiplayer game to be a participating player who obtains a highest-ranking successful result in a corresponding turn of a respective instance of the single-player game, for the administration facility to determine the outcome of the turn of the multiplayer game to be a tie when two or more participating players obtain a same highest-ranking successful result of the corresponding turn of their respective instances of the single-player game or when none of the participating players obtain a successful result of the corresponding turn of their respective instances of the single-player game, for the administration facility to determine the tie as an unfavourable outcome of the turn of the multiplayer game and to carry over the contents of the accumulation account to a next turn of the multiplayer game, alternatively for the administration facility to determine the tie as a favourable outcome of the turn of the multiplayer game and to cause the contents of the accumulation account to be shared between the tied players, for the administration facility to augment the contents of the accumulation account with player wagers from the next turn of the multiplayer game in the event of a carry over, for the administration facility to carry over the contents of the accumulation account to a next turn of the multiplayer game for a maximum of five consecutive ties, and for the administration facility to automatically determine the outcome of a turn of the multiplayer game as a favourable outcome upon the occurrence of a sixth consecutive tie.

Yet further features of the invention provide for each player station to display the progress of each instance of the single-player game played by a participating player, for the at least one turn of the single-player game in each separate instance of the single-player game comprising a single turn of the multiplayer game to be played either sequentially, alternatively simultaneously, and for each successful result of an instance of the single-player game to be associated with a corresponding prize that is independent of the contents of the accumulation account.

There is also provided for the administration facility to award a prize to each participating player in the multiplayer game when a highest ranking successful result occurs in a turn of an instance of the single-player game of any participating player, alternatively when any one of three highest-ranking successful results occurs in a turn of an instance of the single-player game of any participating player, and for the prizes awarded by the administration facility to be independent of the contents of the accumulation account.

There is further provided for each instance of the single-player game to have a bonus result, the occurrence of the bonus result in any instance of the single-player game enabling any one of:

(i) participation by the participating player in whose instance of the single-player game the bonus result occurred, in the next turn of the multiplayer game without requiring a wager, (ii) payment by the operator of the multiplayer gaming system of a wager on behalf of the participating player in whose instance of the single player game the bonus result occurred, on the next turn of the multiplayer game, and (iii) an award of a monetary prize by the operator of the multiplayer gaming system to the participating player in whose instance of the single-player game the bonus result occurred.

There is still further provided for a single turn of the multiplayer game to comprise a plurality of turns, preferably 5, of the single-player game in each separate instance of the single-player game played at a player station in use by a participating player, for each successful result of the single-player game to have an associated points value, for the administration facility to accumulate, for each participating player, points associated with any successful result occurring in that player's plurality of turns in that player's instance of the single-player game, and for the administration facility to determine the winner of the turn of the multiplayer game to be the participating player or participating players with the greatest accumulated point value, and for the administration facility to award the winner of the turn of the multiplayer game the contents of the accumulation account, preferably the contents of the accumulation account less the service fee retained by the operator of the multiplayer gaming system.

There is yet further provided for the administration facility to require each participating player to decide, prior to commencement of each of the plurality of turns in the single-player game, except the first, whether to continue with the multiplayer game by increasing that player's wager, or to withdraw from the turn of the multiplayer game, for the administration facility to accumulate in the accumulation account the cumulative wagers of all participating players, and for the administration facility to retain in the accumulation account the cumulative wagers of any player who withdraws from the turn of the multiplayer game.

There is also provided for the single-player game to be any one of video slots or video poker.

The invention extends to a method of operation of a multiplayer gaming system, comprising the steps of:

enabling each one of a plurality of players to participate in a multiplayer game by playing a separate instance of a same single-player game having a plurality of possible results;

enabling each participating player to place a wager on an outcome of the multiplayer game; and determining an outcome of the multiplayer game as a function of the combined results of the separate instances of the single-player game, the outcome of the multiplayer game being either a favourable outcome if at least one participating player is determined as being a winner of the multiplayer game, or an unfavourable outcome in which none of the participating players is determined as being a winner.

There is further provided for including in a single turn of the multiplayer game at least one turn of the single-player game in each separate instance of the single-player game played by each participating player, for determining an outcome of a turn of the multiplayer game only after completion of the at least one turn of the single-player game in each separate instance of the single-player game for each participating player, respectively, for awarding a prize to the at least one winning player when the outcome of the turn of the multiplayer game is a favourable outcome, for accumulating, in each separate turn of the multiplayer game, all wagers by the participating players in an accumulation account, for establishing a prize pool whose contents are a function of the outcomes of the separate instances of the single-player game, for awarding as the prize to the at least one winning player the contents of the accumulation account, preferably the contents of the accumulation account less a service fee retained by an operator of the multiplayer gaming system, alternatively the contents of a prize pool, the contents of the accumulation account being retained by the operator of the gaming system to fund the prize pool, and for sharing the contents of either one of the accumulation account and the prize pool when the accumulation facility determines a plurality of winners in the turn of the multiplayer game.

There is still further provided for any instance of the single-player game to have a plurality of successful results, the plurality of successful results being ranked in order, from least successful to most successful, for determining the at least one winner of a turn of the multiplayer game to be a participating player who obtains a highest-ranking successful result in a corresponding turn of a respective instance of the single-player game, for determining the outcome of the turn of the multiplayer game to be a tie when two or more participating players obtain a same highest-ranking successful result of the corresponding turn of their respective instances of the single-player game or when none of the participating players obtains a successful result of the corresponding turn of their respective instances of the single-player game, for determining the tie as an unfavourable outcome of the turn of the multiplayer game and carrying over the contents of the accumulation account to a next turn of the multiplayer game, alternatively for determining the tie as a favourable outcome of the turn of the multiplayer game and causing the contents of the accumulation account to be shared between the tied players, for augmenting the contents of the accumulation account with player wagers from the next turn of the multiplayer game in the event of a carry over, for carrying over the contents of the accumulation account a next turn of the multiplayer game for a maximum of five consecutive ties, and for automatically determining the outcome of a turn of the multiplayer game as a favourable outcome upon the occurrence of a sixth consecutive tie.

There is yet further provided for displaying to each participating player the progress of each instance of the single-player game played by all the participating players, for the at least one turn of the single-player game in each separate instance of the single-player game comprising a single turn of the multiplayer game to be played sequentially or, alternatively, simultaneously, and for associating each successful result of an instance of the single-player game with a corresponding prize that is independent of the contents of the accumulation account.

There is also provided for awarding a prize to each participating player in the multiplayer game when a highest ranking successful result occurs in a turn of an instance of the single-player game of any participating player, alternatively when any one of three highest-ranking successful results occurs in a turn of an instance of the single-player game of any participating player, and for awarding the prizes independently of the contents of the accumulation account.

There is also provided for any instance of the single-player game to have a bonus result, the occurrence of the bonus result in any instance of the single-player game enabling any one of:

(i) participation by the participating player in whose instance of the single-player game the bonus result occurred, in the next turn of the multiplayer game without requiring a wager, (ii) payment by the operator of the multiplayer gaming system of a wager on behalf of the participating player in whose instance of the single player game the bonus result occurred, on the next turn of the multiplayer game, and (iii) an award of a monetary prize by the operator of the multiplayer gaming system to the participating player in whose instance of the single-player game the bonus result occurred.

There is also provided associating a points value with each successful result of the single-player game, for including, in a single turn of the multiplayer game, a plurality, preferably 5, of turns of the single-player game in each separate instance of the single-player game played by each participating player, for accumulating, for each participating player, points associated with any successful result occurring in that player's plurality of turns in that player's instance of the single-player game, and for determining the winner of the turn of the multiplayer game to be the participating player, or participating players, with the greatest accumulated point value, and for awarding the winner of the turn of the multiplayer game the contents of the accumulation account, preferably the contents of the accumulation account less the service fee retained by the operator of the multiplayer gaming system.

There is also provided for requiring each participating player to decide, prior to commencement of each of the plurality of turns in the single-player game, except the first, whether to continue with the multiplayer game by increasing that player's wager, or to withdraw from the turn of the multiplayer game, for accumulating in the accumulation account the cumulative wagers of all participating players, and for retaining in the accumulation account the cumulative wagers of any player who withdraws from the turn of the multiplayer game.

BRIEF DESCRIPTION OF THE DRAWINGS

Embodiments of the invention are described below, by way of example only, and with reference to the abovementioned drawings, in which.

DETAILED DESCRIPTION OF THE INVENTION

Figure 1:
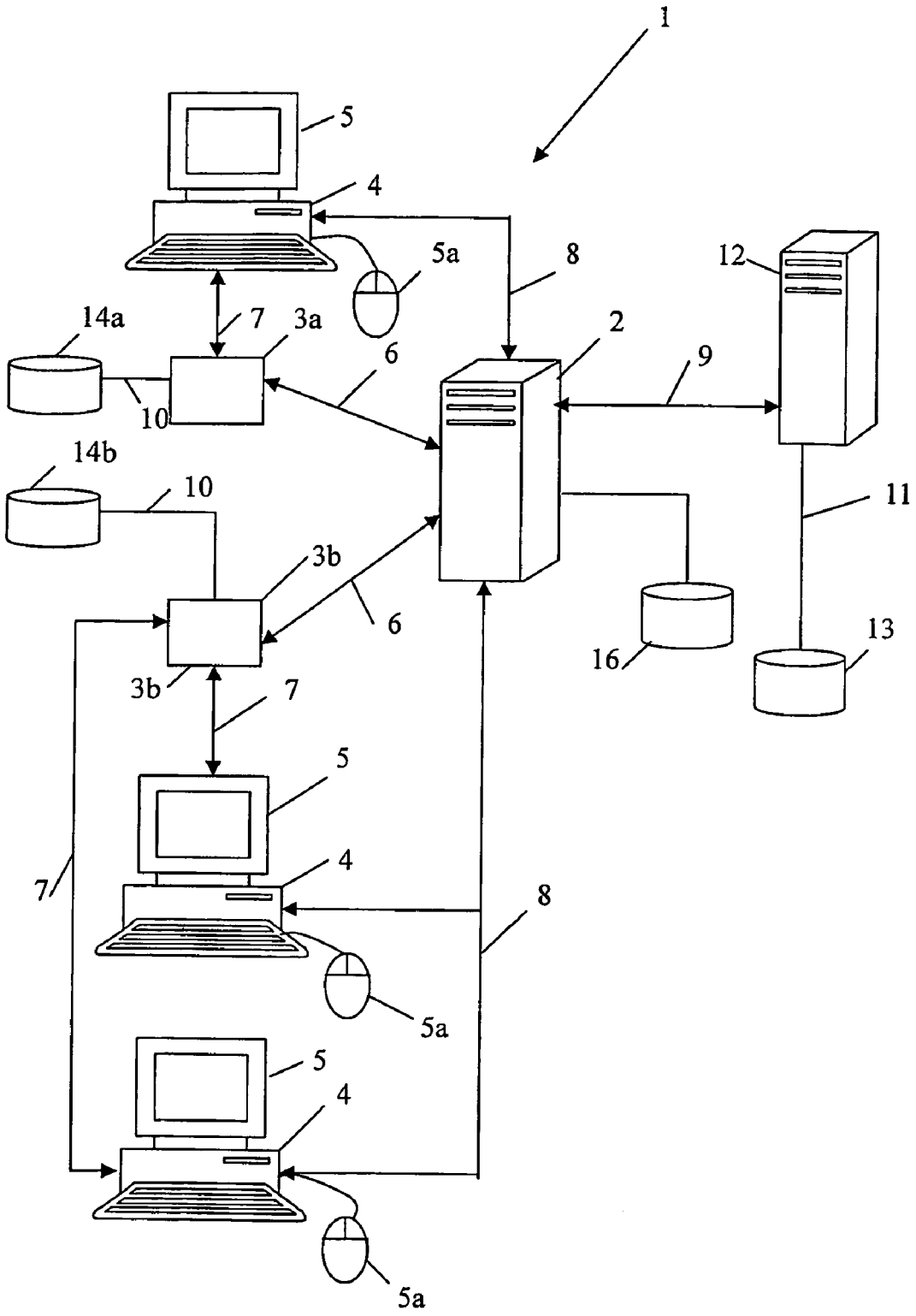
FIG. 1 is functional diagram of a multiplayer gaming system according to the invention.

Referring to FIG. 1, a multiplayer gaming system is indicated generally by reference numeral (1).

This embodiment of the invention will be described with particular reference to a multiplayer game that is based on multiple separate instances of a single-player game of video slots. It is to be clearly understood, however, that the invention extends to include the use of multiple separate instances of other types of single-player games such as video poker, for example.

The multiplayer gaming system (1) includes a gaming server (2), and a number of portals (3*a*, 3*b*) in the form of portal websites on the World Wide Web of the Internet. In this embodiment, each one of the portal websites is an online casino website hosted on a corresponding casino web server (not shown). For convenience, this particular embodiment of the invention will be described with particular reference to only two such online casino websites (3*a*, 3*b*). Each one of the online casino websites (3*a*, 3*b*) is accessible by a would-be video slots player (not shown) through a player station (4) in the form of an Internet-enabled computer workstation having a display monitor (5) and an associated pointing device (5*a*) such as a mouse or, alternatively, a touchpad. In this embodiment, online casino website (3*a*) is shown as having one computer workstation (4) logically connected thereto, whereas casino website (3*b*) is shown as being logically connected to two computer workstations (4). It will be appreciated by those skilled in the art that such online casino websites (3*a*, 3*b*) can be logically connected to any desired number of such computer workstations (4) simultaneously, which number is physically limited only by considerations of processing power and Internet access bandwidth.

The apparatus (1) includes, further, an administration facility (12) in the form of an application web server, which is communicable with the gaming server (2) along a communication network (9). The detailed operation of the application web server (12) will be outlined in the description that follows.

The gaming server (2), the online casino web servers (not shown) corresponding to the online casino websites (3*a*, 3*b*), the computer workstations (4) and the application web server (12) are capable of communicating with each other by means of an open communication network that is, in this embodiment, the Internet. Although the Internet is a single packetswitched communication network, it is represented in FIG. 1 as separate logical communication networks (6, 7, 8, 9, 10 and 11).

The application web server (12) operates a clearing account facility (13) that has a clearing account corresponding to each one of the online casino websites (3*a*, 3*b*). Analogously, each online casino website (3*a*, 3*b*) includes a corresponding credit account facility (14*a*, 14*b*) with a credit account corresponding to each player who participates in a game offered by the online casino. In the illustrated embodiment, therefore, the credit account facility (14*a*) has one player credit account associated with it, while credit account facility (14*b*) has two associated, but separate, player credit accounts.

The gaming server (2) operates under control of a stored server program (not shown) capable of enabling a predetermined number, say 8, of players to play an instance of a multiplayer game that will be referred to, for convenience, as "multiplayer slots". When the number of players reaches this predetermined maximum number, the server program causes a further instance of the game of multiplayer slots to be initiated, the new instance of the multiplayer slots game also being capable of accommodating a further 8 players. In this manner, the gaming server is capable, under stored server program control, to spawn as many separate instances of the game of multiplayer slots as required in order to accommodate a pool of players who desire to play the multiplayer slots game, in groups of a maximum of 8. Each instance of the multiplayer slots game spawned in this manner is treated as totally independent of the other instances of the game.

The online casino websites (3*a*, 3*b*) enable a player who desires to join the game of multiplayer slots to request, by means of one of the computer workstations (4), participation in the game and, once admitted to an instance of the multiplayer slots game, to place a wager on a turn of that instance of the game. Each participating player in an instance of the game is presented with an identical graphical user interface ("GUI") on his respective computer workstation (4) by a separate stored program (not shown) in the workstation. The GUI presents to the player, on the display monitor (5), a display of the reels of a three-reel video slots game. It will be appreciated that the game of video slots is, as is well known in the art, essentially a single-player game. The GUI also presents to the player a display of 7 further sets of reels of a three-reel video slots game. These further sets of reels correspond to the instances of the single-player video slots game played by the other participating players in the particular instance of the multiplayer slots game. The other players in the same instance of the multiplayer game use these additional sets of reels only for presentation purposes in order that each participating player can follow the progress of all the instances of the video slots games played. The GUI clearly distinguishes a player's own set of reels, or instance of the single-player game from those of the other participating players. Each set of reels is identified by a corresponding name, which might be a name assumed by the participating player for participation in the multiplayer slots game, or the participating player's own name.

The stored workstation program (not shown) also enables a participating player to place a wager on a turn of the multiplayer slots game, while the application web server (12) is capable of determining whether any wager placed by any participating player on a turn of the game is successful or unsuccessful according to the rules of the multiplayer game. The stored program in the gaming server (2) also maintains a dynamic register (16) of all players admitted to, and actively participating in, all the spawned instances of the multiplayer slots game from time to time, together with data representative of a corresponding portal (3*a*, 3*b*) through which each participating player accessed the multiplayer slots game. The dynamic register (16) also contains data representative of an instance of the multiplayer game in which the player is participating. The application web server (12) also settles the wagers of the participating players after completion of every turn of any instance of the multiplayer game.

Each computer workstation (4) is a conventional personal computer operating under a Windows 2000 operating system, which is well known and commercially available from the Microsoft Corporation of Redmond, Wash., USA. The gaming server (2) operates under the Windows NT operating system. The stored workstation program (not shown) and the corresponding stored server program will be referred to, for convenience, as a client process and a server process, respectively. The server process generates one or more random events that determine the outcome of the multiplayer slots game, such as determining the outcomes of spins of the reels in the various single-player video slots games of the participating players. The client process of any particular computer workstation (4) obtains the result of the random events from the gaming server (2), along the communication network (9) and displays the outcome of the game on the display monitor (5) of the workstation in an intelligible manner, by causing the player's set of slots reels to spin and to come to rest at a position corresponding to the outcome. In order to play the game of multiplayer slots from any particular computer workstation (4), the client process (not shown) must first be downloaded to that computer workstation from the gaming server (2) or, alternatively from a separate web server (not shown), and then installed on the workstation.

Figure 2:
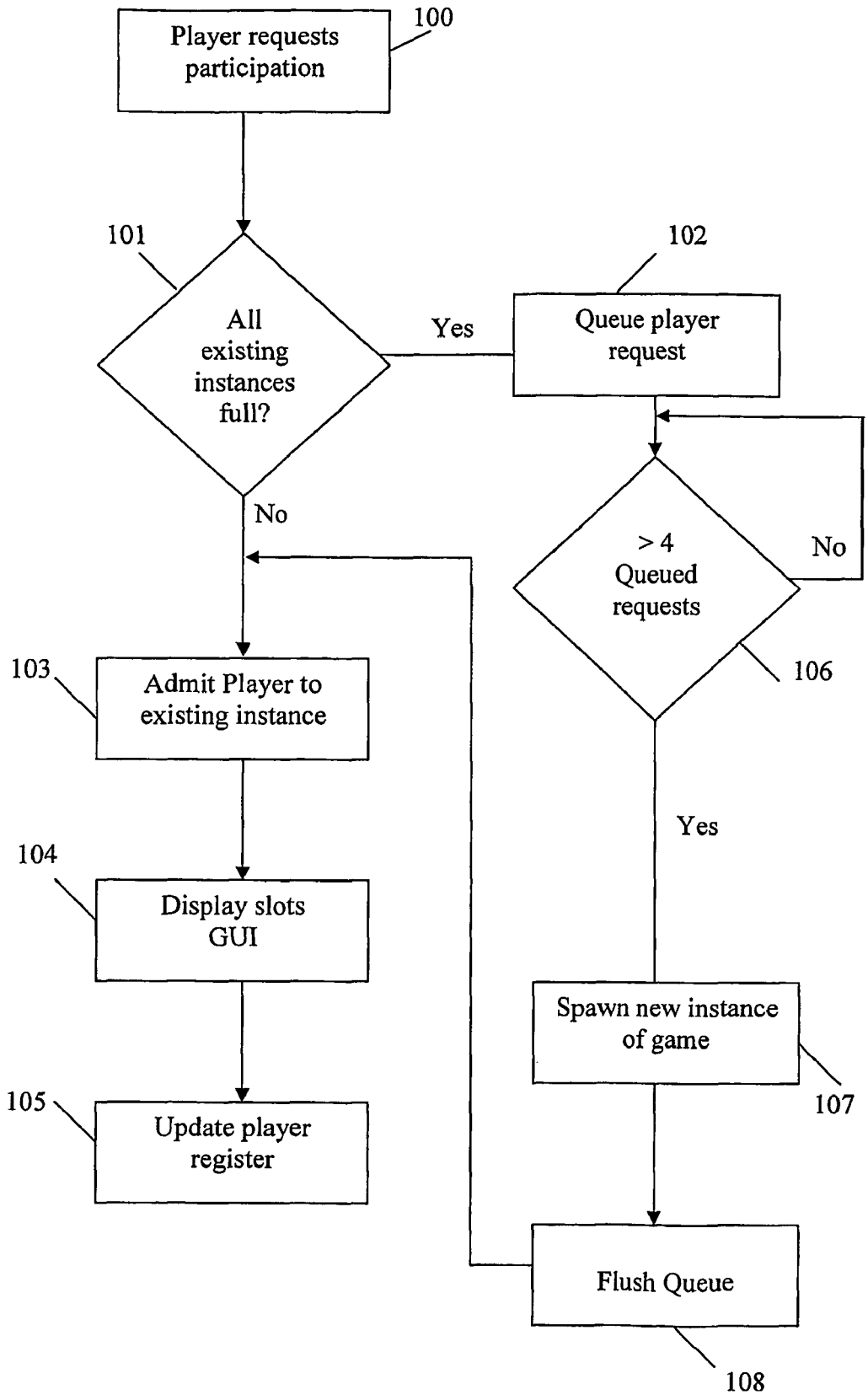
FIG. 2 is a flow diagram of the steps required for a player to participate in a multiplayer game in the multiplayer gaming system of FIG. 1.

In use, a player wishing to participate in the game of multiplayer slots uses a computer workstation (4) to access an online casino website (3*a*, 3*b*) of his choice. A flow diagram outlining the steps required in order for a player to participate in an instance of the game is indicated in FIG. 2. The player is presented with an icon (not shown) on the GUI on his computer workstation (4), which the user can activate in order to request participation in the multiplayer slots game. The user's request for participation (100) is passed by the online casino website (3*a*, 3*b*) to the gaming server (2), which adjudicates and processes the request in the following manner:

1. if all existing instances of the multiplayer slots game are currently being played by 8 players, the existing instances of the game are all fully occupied and the would-be player cannot be admitted to any instance of the game (101). The user is notified of the situation and prompted to join a waiting list of would-be players (102);
2. if any one of the existing instances of the multiplayer slots game does have a vacancy, the would-be player is admitted to that instance of the game (103) or, if previously on the waiting list, is removed therefrom and admitted to that instance of the game. An appropriate multiplayer slots GUI is presented to the newly-admitted player (at 104) to allow him to play the game and to place wagers thereon;
3. the register of active participating players is updated (at 105) to include the details of the newly-admitted player, together with data representative of the online casino from which the player was admitted to the game, as well as the particular instance of the game to which he has been admitted;
4. when the waiting list of would-be players has grown sufficiently large, say 4 or 5 would-be players (106), the gaming server spawns a new instance of the game (107)

to accommodate the would-be players in the waiting list, and the list is flushed (108); and 5. the register of active participating players is updated (105) to include the details of all the newly-admitted players in the newly-spawned instance of the game, together with data representative of the online casino from which the players were admitted to the instance of the game, as well as the particular instance of the game to which the players have been admitted.

Figure 3:
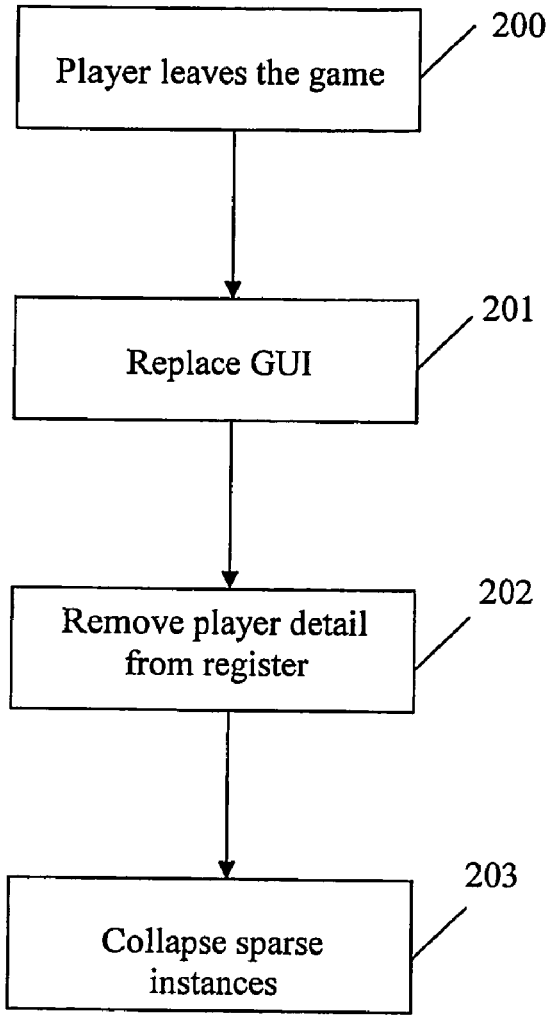
FIG. 3 is a flow diagram of the steps required for a participating player to leave an instance of the multiplayer game in the multiplayer gaming system of FIG. 1.

Any player is able to leave the instance of the multiplayer slots game in which he is participating at any time upon completion of a turn of that instance of the game. A flow diagram outlining the steps required for a player to leave an existing instance of the game is outlined in FIG. 3. When a participating player leaves an instance of the multiplayer slots game (200), the player's departure results in the system (1) undertaking the following actions:

1. the GUI corresponding to the multiplayer slots game on the computer workstation is replaced by one allowing the player to select another casino game to play (201);
2. the departing player's details are removed from the register of active participating players (202); and
3. the remaining instances of the game are analysed in order to collapse any sparsely populated instances of the game and to consolidate the participating players in these instances into a single more densely-populated instance of the game (203).

Figure 4:
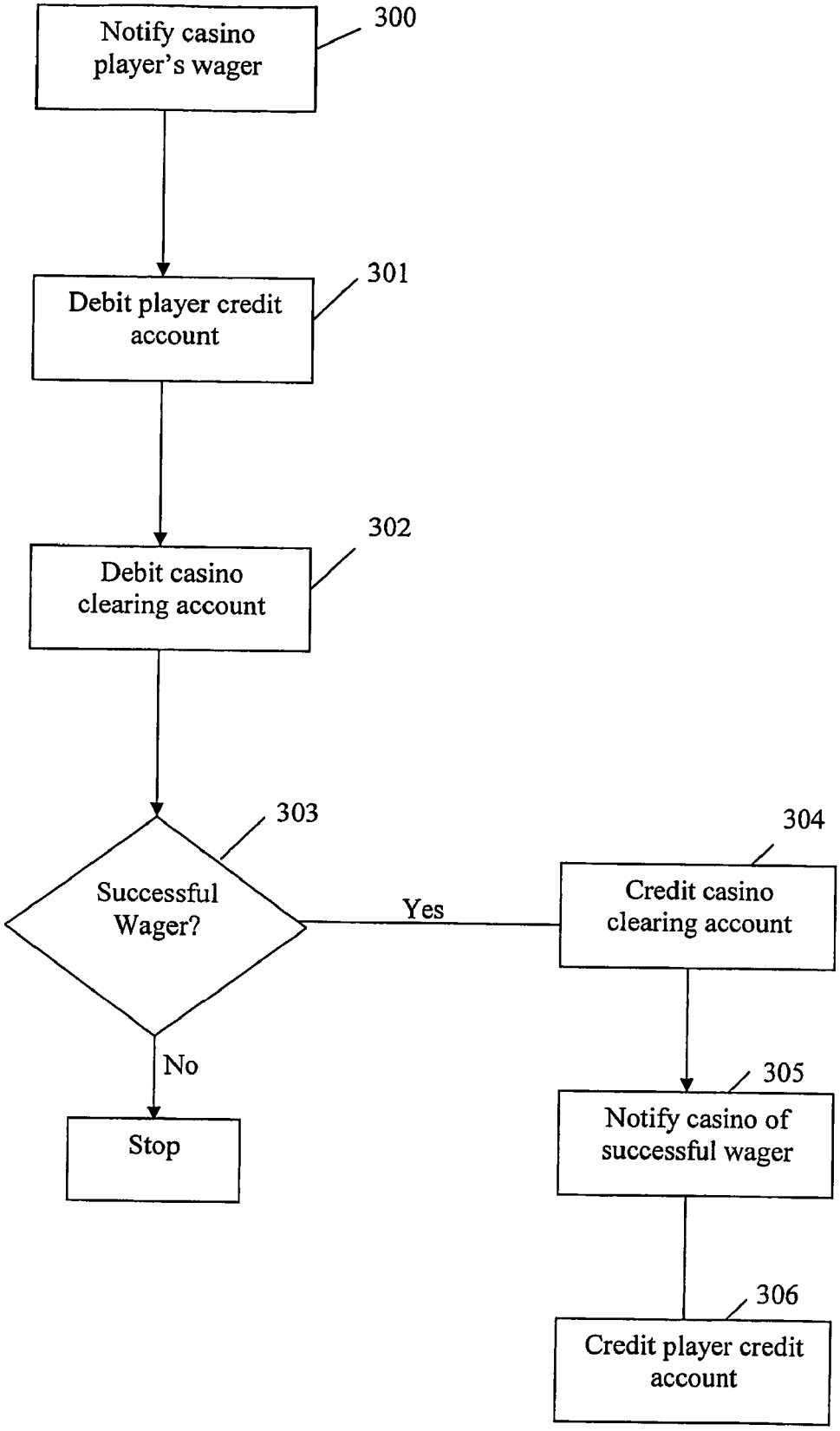
FIG. 4 is a flow diagram of the steps required to settle wagers placed by participating players in the gaming system of FIG. 1.

The participating players in any instance of the game all place wagers on a turn of the multiplayer slots game, as described above. Once the turn of the multiplayer slots game has been completed, the application web server (12) determines which of the participating players is the winner of the turn according to the rules of the game and settles the wagers placed by the participating players on that turn of the instance of the game as follows, as indicated in FIG. 4:

1. an online casino website (3*a*, 3*b*) associated with each participating player who has made a wager on the turn of the multiplayer game notifies the gaming server (2), at (300). Each of the online casino websites (3*a*, 3*b*) then debits the individual credit account of its associated player by an amount equivalent to the magnitude of that player's wager (301);
2. the clearing account of an online casino website (3*a*, 3*b*) associated with each player who has made a wager on the turn of the game is then debited by an amount equivalent to the magnitude of that player's corresponding wager (302);
3. the clearing account of an online casino website (3*a*, 3*b*) associated with the player who has made the successful wager (303) on the turn of the game is credited by an amount equivalent to the total of all the wagers inclusive of the successful wager (304); and
4. the gaming server (2) also notifies the online casino website (3*a*, 3*b*) associated with the successful player (305) and that online casino website credits the individual credit account of the successful player by an amount equivalent to the total of all the wagers inclusive of the successful wager (306).

Figure 5:
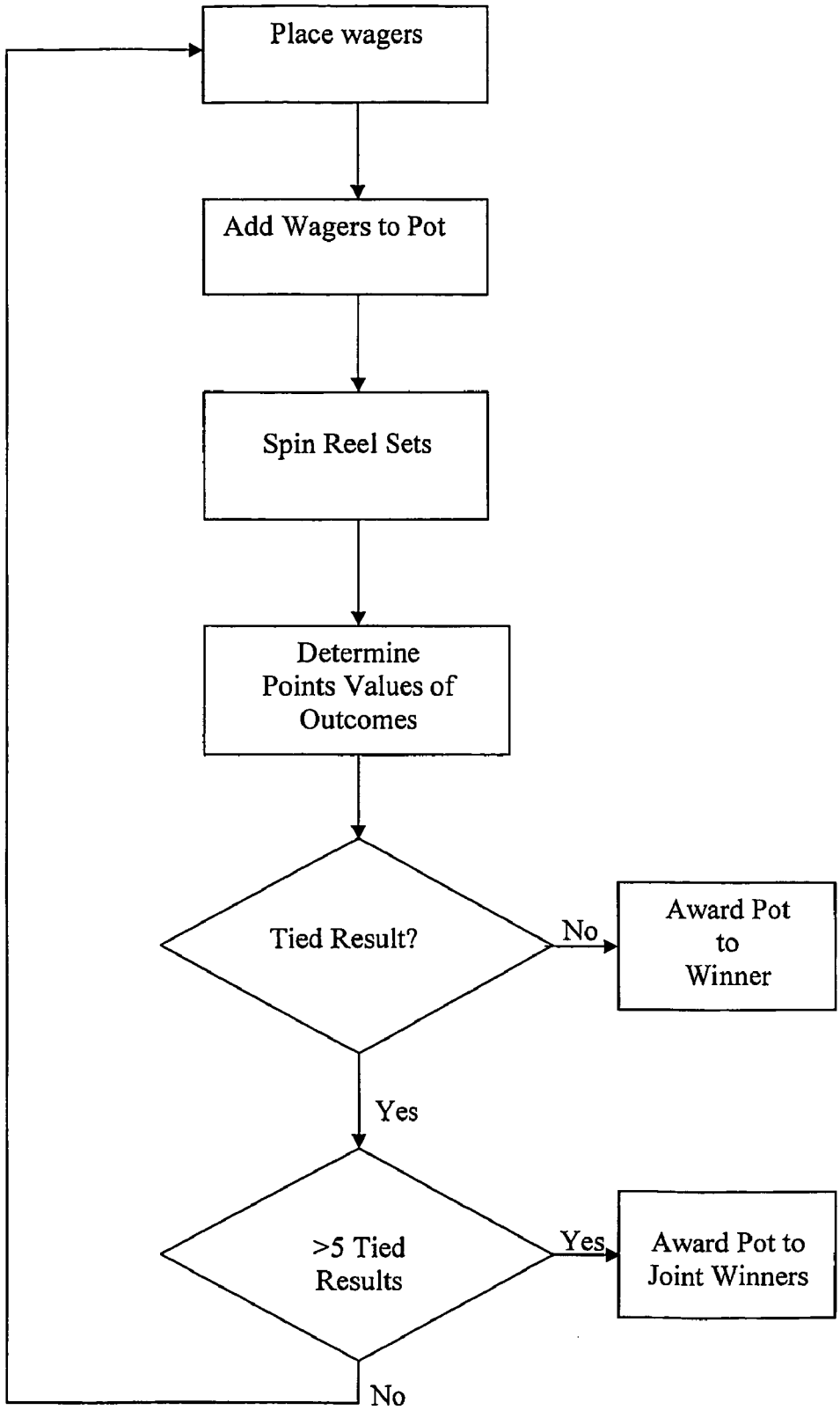
FIG. 5 is a flow diagram of a "Pot Slot" variation of a multiplayer game playable on the multiplayer gaming system of FIG. 1.

The rules of the multiplayer game are outlined below, according to different variations of the game:

1. "Pot Slot" Variation
   - a flow diagram outlining the steps of this variation of the multiplayer game is outlined in FIG. 5;
   - each player wagers a same amount, say $x, on a turn of the multiplayer game. All the player wagers are accumulated in an accumulation account ("the pot"). With eight participating players, the pot will be $8x;
   - once the participating players have all wagered, the sets of slot reels of all the participating players in the instance of the game spin in sequence, while being visible to all players;
   - successful results of a reel spin are awarded the following points values:

| Result | Points |
|---|---|
| 3 × Blue 7 | 1000 |
| 3 × Red 7 | 80 |
| 3 × Any 7 | 40 |
| 3 × Bar3 | 30 |
| 3 × Bar2 | 20 |
| 3 × Bar1 | 10 |
| 3 × Cherry | 10 |
| 3 × AnyBar | 5 |
| Any 2 Cherry | 5 |
| Any 1 Cherry | 2 |

Figure 6:
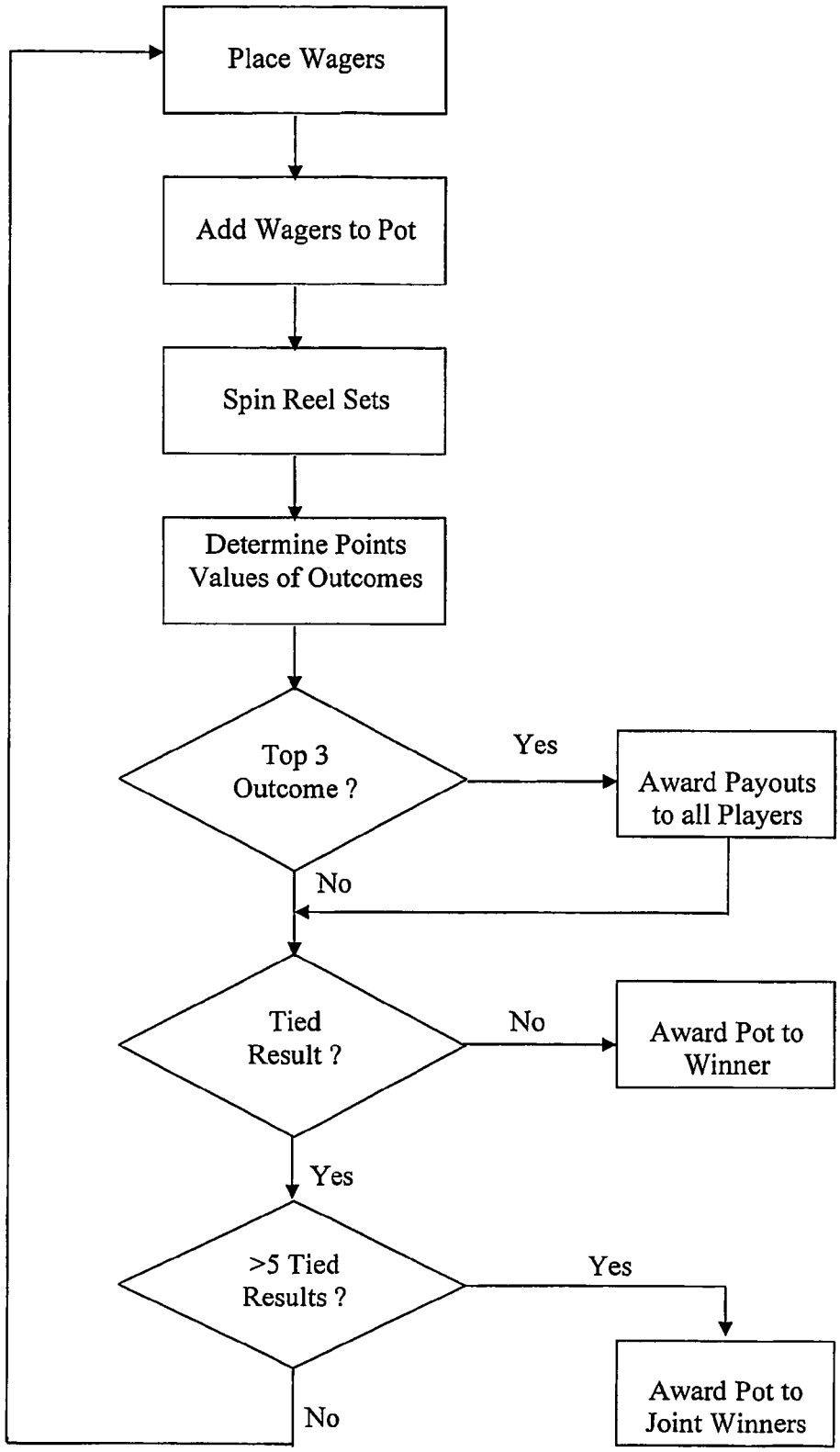
FIG. 6 is a flow diagram of a "Pot Slot with Community Feature" variation of a multiplayer game playable on the multiplayer gaming system of FIG. 1.

- the participating player whose result corresponds to the highest points value wins the pot;
   - if there are two or more participating players whose results correspond to the highest points value, the outcome of the turn of the multiplayer game is a tie. Similarly, if there is no participating player who obtains a successful result, the outcome of the turn of the multiplayer game is a tie;
   - in the event of a tie, the pot is carried over ("carryover") to the next turn of the multiplayer game;
   - in the event of a carryover, each participating player is required to wager a further $x, which is added to the pot;
   - the participating player whose result corresponds to the highest points value wins the pot;
   - the pot is carried over a maximum of five times;
   - after the fifth carryover, in the event of a further tie, the pot is shared equally between the players whose results correspond to the highest points values.
2. "Pot Slot with Community Feature" Variation
   - a flow diagram outlining the steps of this variation of the multiplayer game is outlined in FIG. 6;
   - this variation is the same as the Pot Slot variation of the multiplayer game outlined above with the exception that, in the event of any player obtaining a successful result that is one of the top three outcomes, each participating player unconditionally wins a payout according to the following pay table:

| Result | Winning Player | Remaining Players |
|---|---|---|
| 3 × Blue 7 | $3 000 | $500 each |
| 3 × Red 7 | $500 | $50 each |
| 3 × Any 7 | $50 | $5 each |

Figure 7:
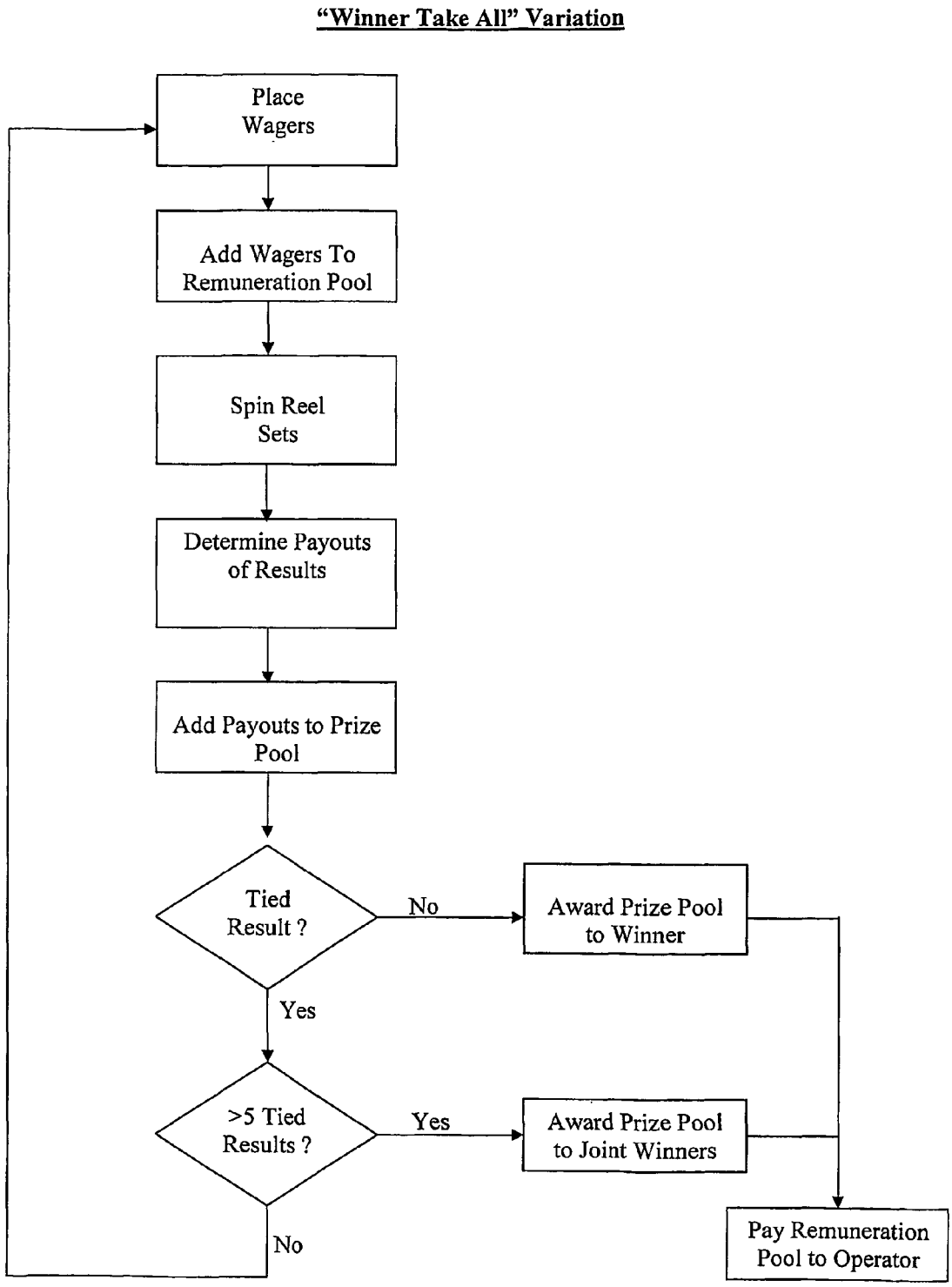
FIG. 7 is a flow diagram of a "Winner Take All" variation of a multiplayer game playable on the multiplayer gaming system of FIG. 1.

- the contest for the pot continues independently of the above payouts, as described above.
3. "Winner Take All" Variation
   - a flow diagram outlining the steps of this variation of the multiplayer game is outlined in FIG. 7;
   - each player wagers a same amount, say $x, on a turn of the multiplayer game. All the player wagers are accumulated in a remuneration pool. With eight participating players, the remuneration pool will be $8x;

once the participating players have all wagered, the set of slot reels of all the participating players in the instance of the game spin in sequence, while being visible to all players;

successful results of a reel spin are awarded the following payouts:

| Result | Payout |
|---|---|
| 3 × Blue 7 | $1000 |
| 3 × Red 7 | $ 80 |
| 3 × Any 7 | $ 40 |
| 3 × Bar3 | $ 30 |
| 3 × Bar2 | $ 20 |
| 3 × Bar1 | $ 10 |
| 3 × Cherry | $ 10 |
| 3 × AnyBar | $ 5 |
| Any 2 Cherry | $ 5 |
| Any 1 Cherry | $ 2 |

the payouts corresponding to all successful results are accumulated in a prize pool and the participating player with the highest-paying successful result wins the prize pool;

if there are two or more participating players with the same highest-paying successful results, the outcome of the turn of the multiplayer game is a tie. Similarly, if there is no participating player who obtains a successful result, the outcome of the turn of the multiplayer game is a tie;

in the event of a tie, the prize pool is carried over to the next turn of the multiplayer game;

in the event of a carryover, each participating player is required to wager a further $x, which is added to the remuneration pool, and payouts of all successful results in the carryover spin are accumulated in the prize pool;

the participating player with the highest-paying successful result in the carryover spin wins the prize pool;

there is a maximum of five consecutive carryovers;

after the fifth carryover, in the event of a further tie, the prize pool is shared equally between the players with the highest paying successful results;

the remuneration pool is paid over to an operator of the multiplayer gaming apparatus in order to fund the payouts won by the participating players.

Figure 8:
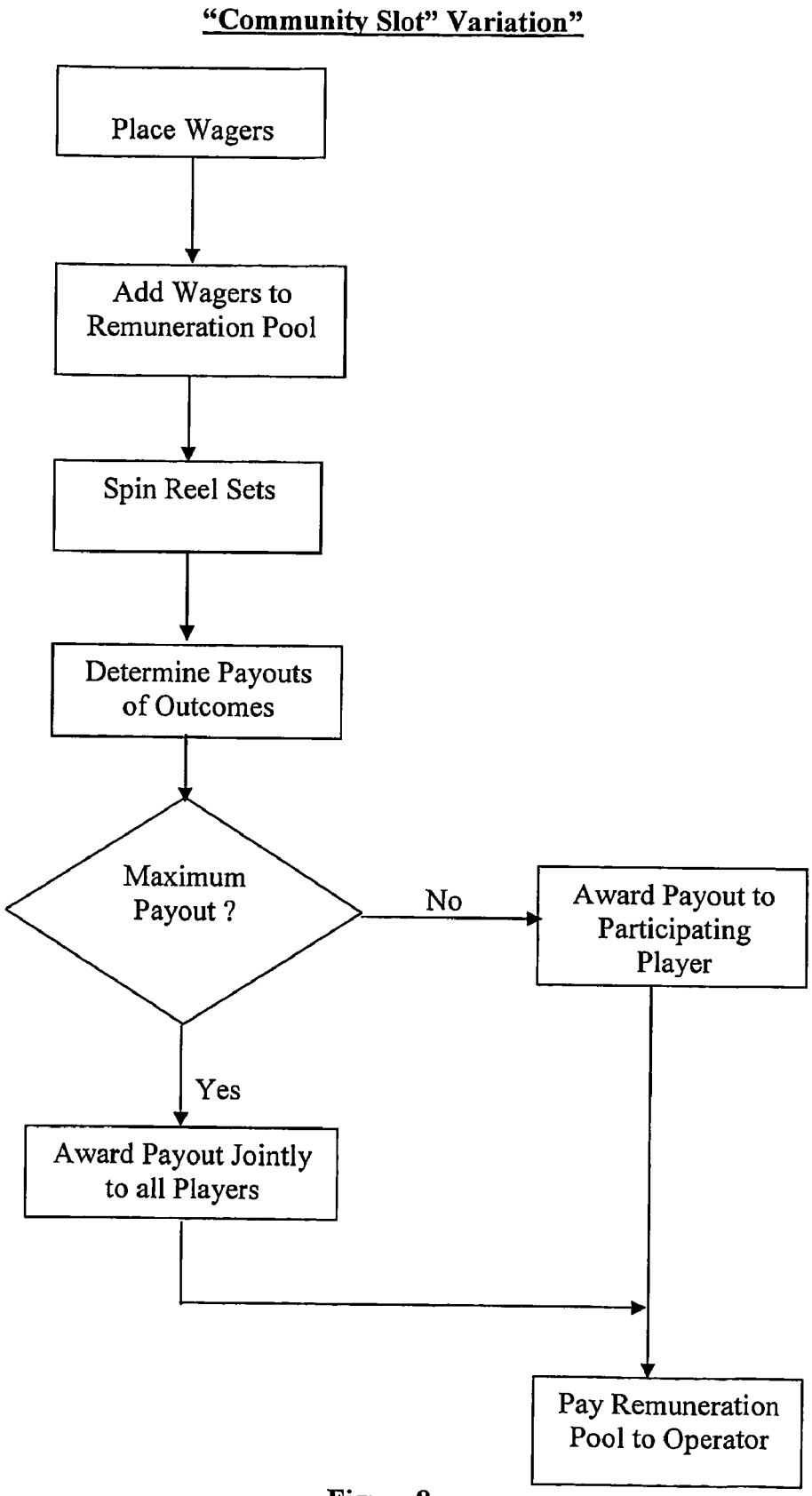
FIG. 8 is a flow diagram of a "Community Slot" variation of a multiplayer game playable on the multiplayer gaming system of FIG. 1.

4. "Community Slot" Variation a flow diagram outlining the steps of this variation of the multiplayer game is outlined in FIG. 8;

each player wagers a same amount, say $x, on a turn of the multiplayer game. All the player wagers are accumulated in a remuneration pool. With eight participating players, the remuneration pool will be $8x;

once the participating players have all wagered, the sets of slot reels of all the participating players in the instance of the game spin in sequence, while being visible to all players;

successful results of a reel spin are awarded the following payouts:

| Result | Payout |
|---|---|
| 3 × Blue 7 | $10000 |
| 3 × Red 7 | $ 80 |
| 3 × Any 7 | $ 40 |

-continued

| Result | Payout |
|---|---|
| 3 × Bar3 | $30 |
| 3 × Bar2 | $20 |
| 3 × Bar1 | $10 |
| 3 × Cherry | $10 |
| 3 × AnyBar | $ 5 |
| Any 2 Cherry | $ 5 |
| Any 1 Cherry | $ 2 |

any player obtaining a successful result wins the corresponding payout, with the exception of the maximum payout, which is divided equally among all the participating players.

the remuneration pool is paid over to an operator of the multiplayer gaming apparatus in order to fund the payouts won by the participating players.

Figure 9:
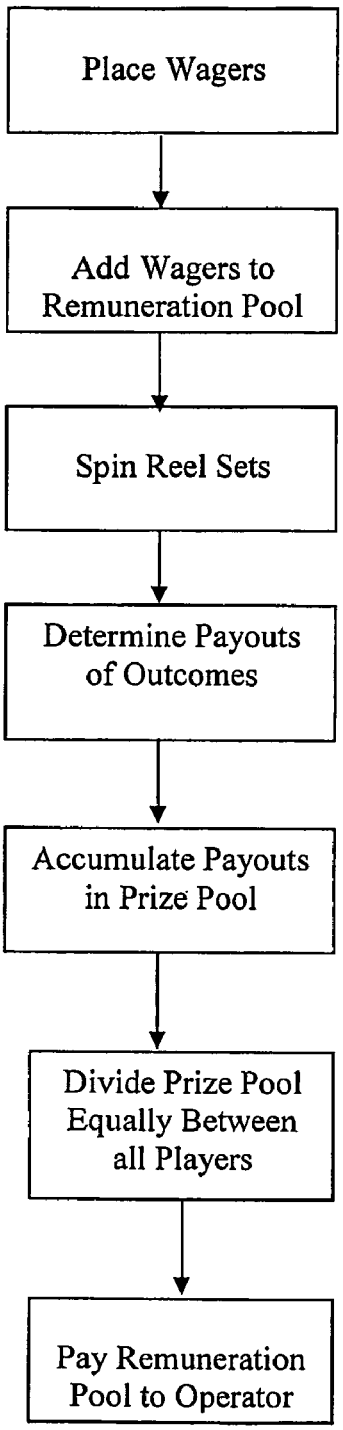
FIG. 9 is a flow diagram of a "Community Slot—Even Distribution" variation of a multiplayer game playable on the multiplayer gaming system of FIG. 1.

5. "Community Slot—Even Distribution" Variation a flow diagram outlining the steps of this variation of the multiplayer game is outlined in FIG. 9;

each player wagers a same amount, say $x, on a turn of the multiplayer game. All the player wagers are accumulated in a remuneration pool. With eight participating players, the remuneration pool will be $8x;

once the participating players have all wagered, the sets of slot reels of all the participating players in the instance of the game spin in sequence, while being visible to all players;

successful results of a reel spin are awarded the following payouts:

| Result | Payout |
|---|---|
| 3 × Blue 7 | $10000 |
| 3 × Red 7 | $ 80 |
| 3 × Any 7 | $ 40 |
| 3 × Bar3 | $ 30 |
| 3 × Bar2 | $ 20 |
| 3 × Bar1 | $ 10 |
| 3 × Cherry | $ 10 |
| 3 × AnyBar | $ 5 |
| Any 2 Cherry | $ 5 |
| Any 1 Cherry | $ 2 |

the payouts corresponding to all successful results are accumulated in a prize pool and the prize pool is divided equally among the participating players;

the remuneration pool is paid over to an operator of the multiplayer gaming apparatus in order to fund the payouts won by the participating players.

Figure 10:
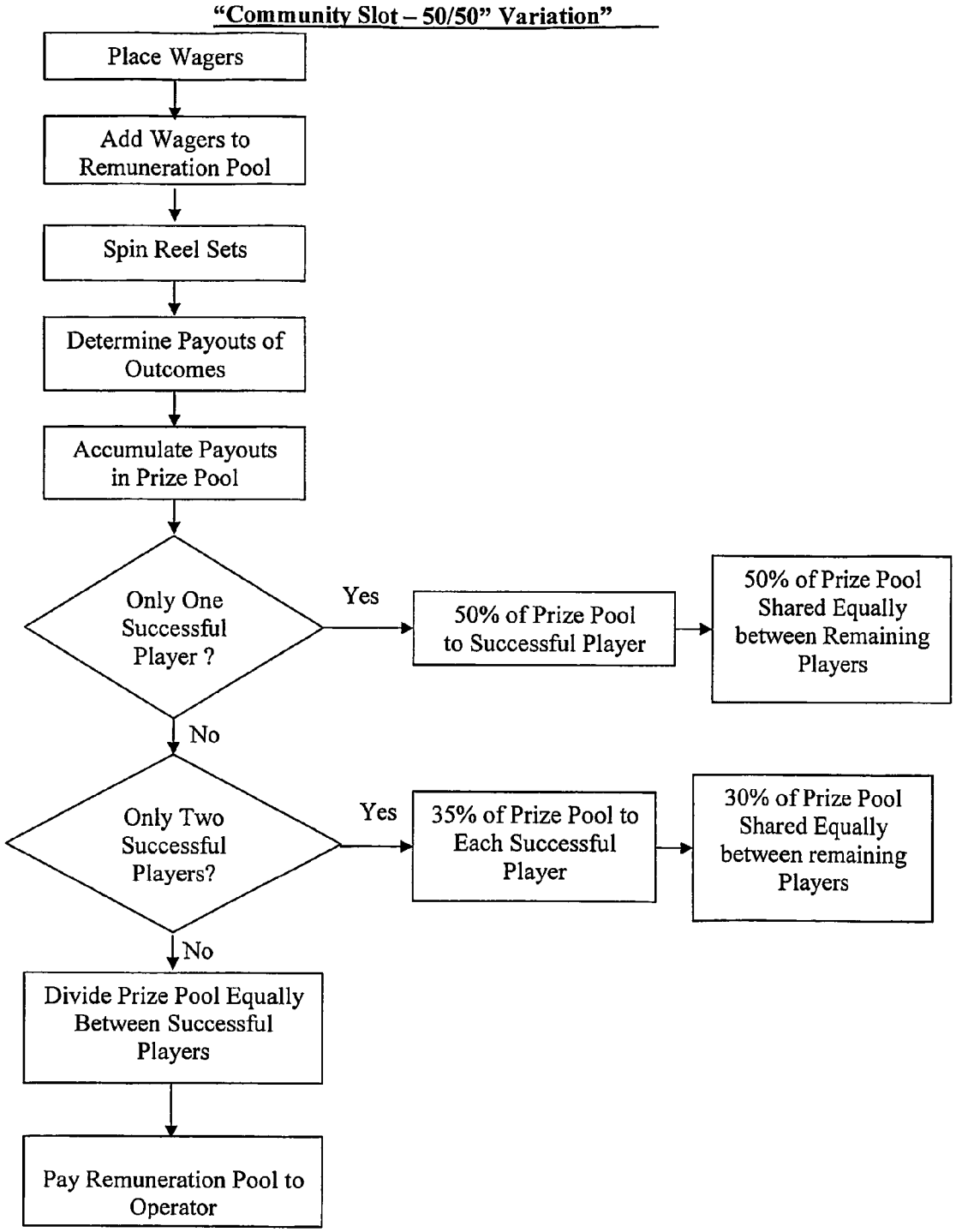
FIG. 10 is a flow diagram of a "Community Slot—50/50" variation of a multiplayer game playable on the multiplayer gaming system of FIG. 1.

6. "Community Slots—50/50" Variation a flow diagram outlining the steps of this variation of the multiplayer game is outlined in FIG. 10;

each player wagers a same amount, say $x, on a turn of the multiplayer game. All the player wagers are accumulated in a remuneration pool. With eight participating players, the remuneration pool will be $8x;

once the participating players have all wagered, the sets of slot reels of all the participating players in the instance of the game spin in sequence, while being visible to all players;

successful results of a reel spin are awarded the following payouts:

| Results | Payout |
|---|---|
| 3 × Blue 7 | $10000 |
| 3 × Red 7 | $ 80 |
| 3 × Any 7 | $ 40 |
| 3 × Bar3 | $ 30 |
| 3 × Bar2 | $ 20 |
| 3 × Bar1 | $ 10 |
| 3 × Cherry | $ 10 |
| 3 × AnyBar | $ 5 |
| Any 2 Cherry | $ 5 |
| Any 1 Cherry | $ 2 |

the payouts corresponding to all successful results are accumulated in a prize pool. If there is only one participating player with a successful result, that player wins 50% of the prize pool, while the balance is divided equally between the remaining participating players. If there are two participating players with successful results, those players each win 35% of the prize pool, while the remaining 30% of the pool is divided equally between the remaining participating players. If there are three or more participating players with successful results, the prize pool is divided equally between the winning players only;

the remuneration pool is paid over to an operator of the multiplayer gaming apparatus in order to fund the payouts won by the participating players.

Figure 11:
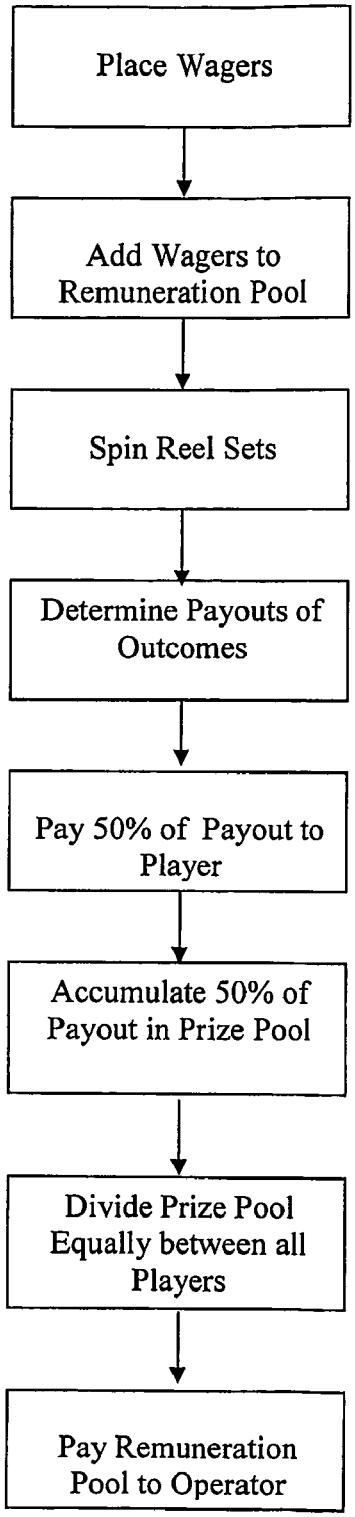
FIG. 11 is a flow diagram of a "Community Slot—50 Pooled" variation of a multiplayer game playable on the multiplayer gaming system of FIG. 1.

7. "Community Slot—50 Pooled" Variation a flow diagram outlining the steps of this variation of the multiplayer game is outlined in FIG. 11;

each player wagers a same amount, say $x, on a turn of the multiplayer game. All the player wagers are accumulated in a remuneration pool. With eight participating players, the remuneration pool will be $8x;

once the participating players have all wagered, the sets of slot reels of all the participating players in the instance of the game spin in sequence, while being visible to all players;

successful results of a reel spin are awarded the following payouts:

| Result | Payout |
|---|---|
| 3 × Blue 7 | $10000 |
| 3 × Red 7 | $ 80 |
| 3 × Any 7 | $ 40 |
| 3 × Bar3 | $ 30 |
| 3 × Bar2 | $ 20 |
| 3 × Bar1 | $ 10 |
| 3 × Cherry | $ 10 |
| 3 × AnyBar | $ 5 |
| Any 2 Cherry | $ 5 |
| Any 1 Cherry | $ 2 |

half the payout attributable to a successful result is awarded to the corresponding participating player, while the balance is accumulated in a prize pool, which is divided equally among all the participating players;

the remuneration pool is paid over to an operator of the multiplayer gaming apparatus in order to fund the payouts won by the participating players.

Figure 12:
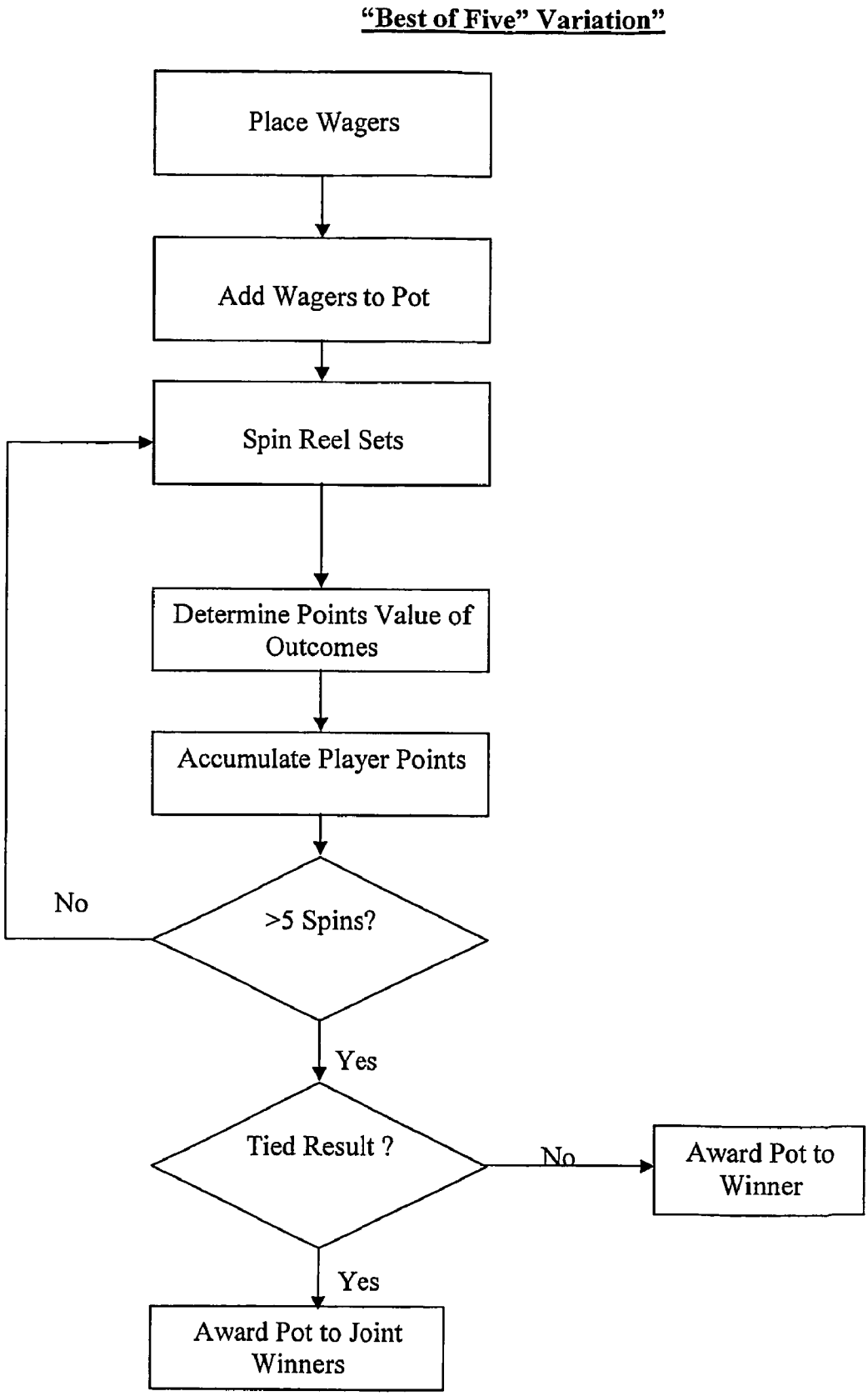
FIG. 12 is a flow diagram of a "Best of 5" variation of a multiplayer game playable on the multiplayer gaming system of FIG. 1.

8. "Best of 5" Variation a flow diagram outlining the steps of this variation of the multiplayer game is outlined in FIG. 12;

each player wagers a same amount, say $x, on a turn of the multiplayer game. All the player wagers are accumulated in a pot. With eight participating players, the pot will be $8x;

once the participating players have all wagered, the sets of slot reels of all the participating players in the instance of the game spin in sequence, while being visible to all players;

successful results of a reel spin are awarded the following point values:

| Result | Points |
|---|---|
| 3 × Blue 7 | 1000 |
| 3 × Red 7 | 80 |
| 3 × Any 7 | 40 |
| 3 × Bar3 | 30 |
| 3 × Bar2 | 20 |
| 3 × Bar1 | 10 |
| 3 × Cherry | 10 |
| 3 × AnyBar | 5 |
| Any 2 Cherry | 5 |
| Any 1 Cherry | 2 |

each participating player is entitled to five turns of the single-player slots game;

a player accumulates points corresponding to all successful results obtained during the five turns of the single-player slots game;

when each participating player has completed their respective five turns, the player with the highest accumulated points value wins the pot;

if there are two or more participating players with the same highest accumulated points value, the outcome of the turn of the multiplayer game is a tie;

in the event of a tie, the pot is shared equally between the players with the highest accumulated points values.

Figure 13:
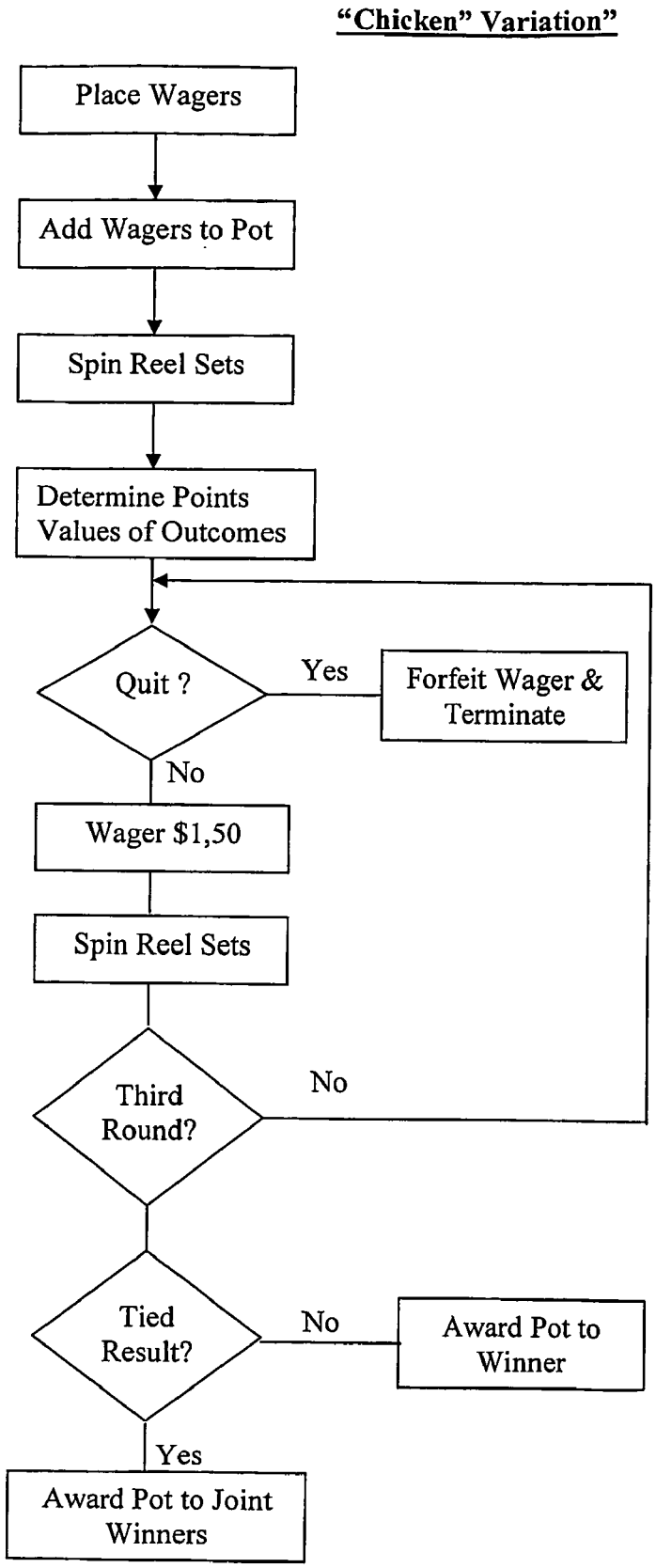
FIG. 13 is a flow diagram of a "Chicken" variation of a multiplayer game playable on the multiplayer gaming system of FIG. 1.

9. "Chicken" Variation a flow diagram outlining the steps of this variation of the multiplayer game is outlined in FIG. 13;

each player wagers a same amount, say $x, on a turn of the multiplayer game. All the player wagers are accumulated in a pot. With eight participating players, the pot will be $8x;

each participating player is entitled to three turns of the single-player slots game, which make up a single turn of the multiplayer game;

once the participating players have all wagered, the sets of slot reels of all the participating players spin simultaneously in the first turn of the single-player game, while not being visible to all players;

successful results of a reel spin are awarded the following points values:

| Result | Points |
|---|---|
| 3 × Blue 7 | 1000 |
| 3 × Red 7 | 80 |
| 3 × Any 7 | 40 |
| 3 × Bar3 | 30 |
| 3 × Bar2 | 20 |
| 3 × Bar1 | 10 |
| 3 × Cherry | 10 |

-continued

| Result | Points |
|---|---|
| 3 × AnyBar | 5 |
| Any 2 Cherry | 5 |
| Any 1 Cherry | 2 |

in the second turn of the single-player game, each player is required to take one of three actions, namely to "Quit", or to "Bet", as follows:

"Quit"—the participating player withdraws from the game and forfeits his prior wager;

"Bet"—the participating player survives and makes an additional wager of $1,50, and re-spins his reel set;

in the third turn of the single-player game, each player who has not previously Quit is again required to Quit or to Bet, as described above;

the surviving player with a highest-ranking successful result wins the pot;

if there are two or more surviving players with the same highest-ranking successful results, the outcome of the turn of the multiplayer game is a tie;

in the event of a tie, the pot is shared equally between surviving players with the same highest-ranking successful result.

10. "Free Spins" Variation each reel of the single-player slots game contains an indicium referred to as a "free spins" symbol (not shown);

when this indicium occurs in a result of a player's turn of the multiplayer slots game, the result is deemed to be a bonus result and the player is permitted to enter the next turn of the multiplayer game free of charge, without the necessity of first placing a wager. Alternatively, that participating player's wager on the next turn of the multiplayer game is funded by the operator of the multiplayer gaming apparatus.

The wagers placed by the players participating in the multiplayer slots game are made with credit purchased by such players prior to their participation in the game. For this purpose, each online casino (3*a*, 3*b*) includes credit-dispensing means (not shown) capable of dispensing credit to any player who wishes to participate in the game. The player may purchase credit by means of conventional credit or debit card payment facilities that are well known in the art and which will not be described here in detail. Whenever a player purchases credit from the credit-dispensing means, the corresponding online casino (3*a*, 3*b*) credits that player's credit account with an amount equivalent to the quantity of credit purchased by the player.

The above embodiment of the invention does not provide any compensation for an operator of the multiplayer gaming system (1) who provides the participating players with a facility to play the multiplayer slots game, or for the online casino websites (3*a*, 3*b*) that make their players available to the gaming server (2) for establishment of the multiplayer slots game. In a variation of the above embodiment, the application web server (12) withholds a portion of the pot or, alternatively, a fixed amount, on each turn of the multiplayer slots game as a rake for the benefit of the operator of the gaming server (2) and the online casino websites (3*a*, 3*b*). A portion of the rake is credited to the clearing account of each online casino (3*a*, 3*b*) as a function of the proportion of players participating in the instance of the multiplayer game through that particular casino website. In this variation of the embodiment, the clearing account of the casino (3*a*, 3*b*) associated with the player who has made a successful wager on the turn of the game is credited with an amount equivalent to the total of all the wagers inclusive of the successful wager, less the amount of the rake. Analogously, the credit account of the player who has made the successful wager is credited by an amount equivalent to the total of all the wagers inclusive of the successful wager, less the rake.

It will be appreciated by those skilled in the art that the invention permits implementation of a multiplayer game out of separate instances of a traditionally single-player game played by each one of a plurality of players. This is achieved by combining an adjudication process together with the separate instances of the single-player game that provides for the determination of a winner, or joint winners, of the multiplayer game as a function of the individual outcomes of the multiple separate instances of the single-player game.

The resulting multiplayer game is an exciting one that can cause emotions of the participating players to swing widely. For example, when a player obtains a high-ranking successful outcome during a turn of the multiplayer game, his desire is that all subsequent players obtain unsuccessful or lower-ranking outcomes that will not affect that player's chance of winning the turn of the multiplayer game. If, on the other hand, a subsequent participating player obtains a better outcome, then the preceding player's desire will change to one that another player will obtain a matching result, thereby resulting in a carryover that will provide the first player with another chance of winning the turn of the multiplayer game.

It will be further appreciated that such an arrangement where players from several online casino websites (3*a*, 3*b*) are pooled for the purpose of establishing a multiplayer game, requires the use of a clearing account facility to manage and process the flow of credit between the various online casinos from which the pool of players are drawn.

Numerous modifications are possible to this embodiment without departing from the scope of the invention. Foremost, the single-player game on which the multiplayer game is based may be a different game, such as video poker, for example, or roulette. The single-player game of video poker has a hierarchy of successful outcomes and may be used in place of video slots without any substantial changes to the rules of the multiplayer game described above. Every participating player starts an instance of the single-player video poker game with an identical hand and each player is required to decide which cards to hold in his own hand. Roulette is different in that there is no hierarchy of outcomes but can, nevertheless, be used as the underlying single-player game by providing each participating player with a same initial stake, and selecting the winner of the multiplayer game to be the player who registers the greatest increase, or smallest loss, of initial stake in a turn of the game of roulette.

Further, other variations to the rules of the multiplayer game are possible, other than those described above. For example, the "Community Slot" variation can be altered to provide that the payouts corresponding to the three highest-ranking successful results are divided equally among all the participating players, instead of only the maximum payout. Additionally, the "Best of 5" variation may be modified to provide that a winner of a turn of the multiplayer slots game is not the player with a highest accumulates points value over five turns of the single-player slots game, but rather the winner who obtains a highest-ranking successful result in any of the five turns of the single-player slots game. Finally, the "Chicken" variation may be modified to provide a player with three choices in the second and third turns of the single-player game, namely Quit, Bet and Raise. Under the Bet option, the participating player survives by making an additional wager of $1.50, but does not re-spin his reel set, while in the Raise option, the participating player survives by making an additional wager of $3.00 and is entitled to re-spin his reel set.

Still further, the multiplayer gaming system (1) need not be an on-line embodiment as described above, but may, for example, be an embodiment suitable for deployment in a land-based establishment such as a casino. In this instance, the multiplayer gaming system (1) may be deployed as a bank of adjacent player stations, each linked to the administration facility (12) by means of a local area network.

Yet further, it is also possible to determine the winner or winners of a turn of the multiplayer game in a different manner to that described above. For instance, the gaming server (2) generates a first random number between 1 and 8, which represents a number of winners of the turn of the multiplayer game. This is followed by a random selection from among the participating players, of a group of players equal in number to the first random number generated by the gaming server (2). This group of participating players constitutes the individuals who are the winners of the particular turn of the game. Although this method of selecting a winner or winners of the turn of the game is not based strictly on the results of separate instances of a game of video slots, the user interface and simulation presented to the participating players may still be in the form of a video slots game as described above. For variations of the multiplayer game that involve carryovers, the gaming server (2) can generate a second random number which represents the number of ties in the particular turn of the multiplayer game that will occur in the simulations of the participating players. As an alternative, the winner or winners may be determined by reversing the above procedure, namely by first randomly selecting the number of ties and then randomly selecting the number of winners in each turn of the multiplayer game.

It is not necessary or essential that the gaming server (2) maintain a waiting list of would-be players from which players are admitted to vacant playing positions in existing instances of the multiplayer game, and according to which new instances of the multiplayer game are spawned when all existing instances are fully occupied. As an alternative, a desired number of instances of the game may be spawned ab initio, with players able to enter and leave any instance of the multiplayer game at will, thereby dispensing with the waiting list altogether. It is also not necessary for separate sparsely-populated instances of the multiplayer game be collapsed to consolidate participating players in these instances of the game into a single more densely-populated instance of the multiplayer game. Sparsely populated instances of the multiplayer game function as effectively as fully populated ones. The online casino websites (3*a*, 3*b*) need not offer the players other casino games for play.

Additionally, each spawned instance of the multiplayer game, or slots room, may be uniquely named, with naming rights being awarded to participating players who are deemed to be high rollers, thus increasing the attractiveness of the system (1) to prospective players. A high roller may also rent one or more slots rooms from an operator of the multiplayer gaming system (1), with revenue arising from the slots rooms being shared between the operator and the high roller. This mode of operation provides an incentive to the high roller to promote his slots rooms and to create virtual slots communities in order to maximise revenue therefrom.

It is also possible for the highest-ranking outcome of the single-player game to be linked to a payout that is a progressive jackpot, incremented by a proportion of each player wager.

Still further, the functions of the gaming server (2) and the application web server (12) may be consolidated and performed by a single processor. The application web server (12) can be arranged to monitor the individual credit account balances of the participating players at the online casino websites (3*a* and 3*b*) and to cause the gaming server (2) to terminate participation in the game of any player whose credit account balance drops below a predetermined minimum threshold. Yet further, the administration facility may also require each clearing account associated with an on-line casino website to exceed a prescribed minimum balance at all times, and for the administration facility (12) to terminate participation in the game of all players who have accessed the game through an online casino website whose associated account balance falls below the prescribed minimum balance. Yet further, the credit dispensing means (not shown) may be a centralised credit dispensing means, instead of a distributed one available through each online casino website (3*a*, 3*b*). Finally, a portal need not be an online casino website where a variety of different games are offered to a player, but rather a slots room where multiplayer slots is the only game available to would-be players.

The technical problem solved by this invention is to enable implementation of multiplayer games, such as those mentioned above, which are based on traditionally single-player games, drawing and pooling players from different, possibly competing, entities such as online casinos or other groups such as sports betting organisations and the like. The invention performs dynamic load management by spawning new instances of the multiplayer game and collapsing and merging sparsely populated instances of the game to accommodate changing levels of player demand.

The invention therefore provides a novel apparatus and method for establishing and conducting the progress of a multiplayer game that is based on multiple instances of a traditionally single-player game played by each one of a plurality of players.

The invention claimed is:

1. A multiplayer gaming system facilitating a number of participating players to play a multiplayer wager game, each participating player associated with a player station, each player station being usable by a respective participating player to play a separate instance of a same single-player game having a plurality of possible results, the player station enabling the participating player to place a wager on an outcome of the multiplayer wager game; comprising:

a gaming server and an administration facility communicable with each one of the plurality of player stations, wherein the gaming server is operable to group the plurality of player stations into a single instance of the multiplayer wager game in which each player plays an instance of the single player game, and wherein the administration facility is operable to determine an outcome of the multiplayer wager game as a function of the combined results of the separate instances of the single-player game played at the plurality of player stations, the outcome of the multiplayer wager game being either a favourable outcome if at least one participating player is determined by the administration facility as being a winner of the multiplayer wager game, or an unfavourable outcome in which none of the participating players is determined as being a winner; and wherein a single turn of the multiplayer wager game comprises at least one turn of the single-player game in each separate instance of the single-player game played at a player station in use by a participating player.

2. A multiplayer gaming system as claimed in claim 1, wherein the administration facility determines an outcome of the turn of the multiplayer wager game only after completion of the at least one turn of the single-player game in each separate instance of the single-player game for each participating player.

3. A multiplayer gaming system as claimed in claim 1, wherein the administration facility awards a prize to the at least one winning player when the outcome of the turn of the multiplayer wager game is a favourable outcome.

4. A multiplayer gaming system as claimed in claim 3, wherein the administration facility accumulates, in each separate turn of the multiplayer wager game, all wagers by the participating players in an accumulation account.

5. A multiplayer gaming system as claimed in claim 4, wherein the administration facility establishes a prize pool whose contents are a function of the outcomes of the separate instances of the single-player game played at the plurality of player stations.

6. A multiplayer gaming system as claimed in claim 5, wherein the prize awarded to the at least one winning player is one of the contents of the accumulation account, the contents of the accumulation account less a service fee retained by an operator of the multiplayer gaming system, and the contents of the prize pool, the contents of the accumulation account being retained by the operator of the gaming system to fund the prize pool.

7. A multiplayer gaming system as claimed in claim 6, wherein the contents of either one of the accumulation account and the prize pool are shared when the accumulation facility determines a plurality of winners in the turn of the multiplayer wager game.

8. A multiplayer gaming system as claimed in claim 1, wherein any instance of the single-player game has a plurality of potential successful results, the plurality of successful results capable of being in ranked order, from least successful to most successful.

9. A multiplayer gaming system as claimed in claim 8, wherein the administration facility determines the at least one winner of a turn of the multiplayer wager game to be a participating player who obtains a highest-ranking successful result in a corresponding turn of a respective instance of the single-player game.

10. A multiplayer gaming system as claimed in claim 9, wherein the administration facility determines the outcome of the turn of the multiplayer wager game to be a tie when two or more participating players obtain a same highest-ranking successful result of the corresponding turn of their respective instances of the single-player game or when none of the participating players obtain a successful result of the corresponding turn of their respective instances of the single-player game.

11. A multiplayer gaming system as claimed in claim 10, wherein the administration facility accumulates, in each separate turn of the multiplayer wager game, all wagers by the participating players in an accumulation account, and wherein the administration facility determines the tie as an unfavourable outcome of the turn of the multiplayer wager game and carries over the contents of the accumulation account to a next turn of the multiplayer wager game.

12. A multiplayer gaming system as claimed in claim 10, wherein the administration facility accumulates, in each separate turn of the multiplayer wager game, all wagers by the participating players in an accumulation account, and wherein the administration facility determines the tie as a favourable outcome of the turn of the multiplayer wager game and causes the contents of the accumulation account to be shared between the tied players.

13. A multiplayer gaming system as claimed in claim 11, wherein the administration facility augments the contents of the accumulation account with player wagers from the next turn of the multiplayer wager game in the event of a carry over.

14. A multiplayer gaming system as claimed in claim 11, wherein the administration facility carries over the contents of the accumulation account to a next turn of the multiplayer wager game for a maximum of five consecutive ties.

15. A multiplayer gaming system as claimed in claim 14, wherein the administration facility automatically determines the outcome of a turn of the multiplayer wager game to be a favourable outcome upon the occurrence of a sixth consecutive tie.

16. A multiplayer gaming system as claimed in claim 1, wherein each player station displays the progress of each instance of the single-player game played by a participating player.

17. A multiplayer gaming system as claimed in claim 1, wherein the at least one turn of the single-player game in each separate instance of the single-player game comprising a single turn of the multiplayer wager game are played either sequentially or simultaneously.

18. A multiplayer gaming system as claimed in claim 4, wherein each successful result of an instance of the single-player game is associated with a corresponding prize that is independent of the contents of the accumulation account.

19. A multiplayer gaming system as claimed in claim 1, wherein any instance of the single-player game has a plurality of potential successful results, the plurality of successful results capable of being in ranked order, from least successful to most successful, and wherein the administration facility awards a prize to each participating player in the multiplayer wager game when a highest-ranking successful result occurs in a turn of an instance of the single-player game of any participating player.

20. A multiplayer gaming system as claimed in claim 1, wherein any instance of the single-player game has a plurality of potential successful results, the plurality of successful results capable of being in ranked order, from least successful to most successful, and wherein the administration facility awards a prize to each participating player in the multiplayer wager game when any one of three highest-ranking successful results occurs in a turn of an instance of the single-player game of any participating player.

21. A multiplayer gaming system as claimed in claim 20 wherein the administration facility accumulates, in each separate turn of the multiplayer wager game, all wagers by the participating players in an accumulation account, and wherein the prizes awarded by the administration facility are independent of the contents of the accumulation account.

22. A multiplayer gaming system as claimed in claim 1, wherein the single-player game has a bonus result, the occurrence of the bonus result in any instance of the single-player game enabling any one of:

(i) participation by the participating player in whose instance of the single-player game the bonus result occurred, in the next turn of the multiplayer wager game without requiring a wager, (ii) payment, by the operator of the multiplayer gaming system, of a wager on the next turn of the multiplayer wager game on behalf of the participating player in whose instance of the single-player game the bonus result occurred, and (iii) an award of a monetary prize by the operator of the multiplayer gaming system to the participating player in whose instance of the single-player game the bonus result occurred.

23. A multiplayer gaming system as claimed in claim 1, wherein a single turn of the multiplayer wager game comprises a plurality of turns of the single-player game in each separate instance of the single-player game played at a player station in use by a participating player.

24. A multiplayer gaming system as claimed in claim 23, wherein each successful result of the single-player game has an associated points value.

25. A multiplayer gaming system as claimed in claim 24, wherein the administration facility accumulates, for each participating player, points associated with any successful result occurring in that player's plurality of turns in that player's instance of the single-player game.

26. A multiplayer gaining system as claimed in claim 25, wherein the administration facility determines the winner of the turn of the multiplayer game to be the participating player or participating players with the greatest accumulated point value.

27. A multiplayer gaming system as claimed in claim 26, wherein the administration facility accumulates, in each separate turn of the multiplayer wager game, all wagers by the participating players in an accumulation account, and wherein the administration facility awards the winner of the turn of the multiplayer wager game the contents of the accumulation account or the contents of the accumulation account less a service fee retained by the operator of the multiplayer gaming system.

28. A multiplayer gaming system as claimed in claim 23, wherein the administration facility requires each participating player to decide, prior to commencement of each of the plurality of turns in the single-player game, except the first, whether to continue with the multiplayer wager game by increasing that player's wager, or to withdraw from the turn of the multiplayer wager game.

29. A multiplayer gaming system as claimed in claim 28, wherein the administration facility accumulates in an accumulation account the cumulative wagers of all participating players.

30. A multiplayer gaming system as claimed in claim 29, wherein the administration facility retains in the accumulation account the cumulative wagers of any player who withdraws from the turn of the multiplayer wager game.

31. A multiplayer gaming system as claimed in claim 1, wherein the single-player game is any one of video slots, video poker, or roulette.

32. A method of operation of a multiplayer gaming system, comprising the steps of:

providing computer instructions to a plurality of gaming workstations enabling each one of a plurality of players using such workstations to participate in a multiplayer wager game by playing a separate instance of a same single-player game having a plurality of possible results;

the instructions further enabling each participating player to place a wager on an outcome of the multiplayer wager game and transmit such wager to a gaming server;

and using an administration facility associated with the gaming server to determine an outcome of the multiplayer wager game as a function of the combined results of the separate instances of the single-player game, the outcome of the multiplayer wager game being either a favorable outcome if at least one participating player is determined as being a winner of the multiplayer wager game, or an unfavorable outcome in which none of the participating players is determined as being a winner; wherein a single turn of the multiplayer wager game comprises at least one turn of the single-player game in each separate instance of the single-player wager game played at a player station in use by a participating player.

33. A method as claimed in claim 32, wherein an outcome of a turn of the multiplayer wager game is determined only after completion of the at least one turn of the single-player game in each separate instance of the single-player game for each participating player, respectively.

34. A method as claimed in claim 32, wherein a prize is awarded to the at least one winning player when the outcome of the turn of the multiplayer wager game is a favourable outcome.

35. A method as claimed in claim 32, further comprising the step of accumulating, in each separate turn of the multiplayer wager game, all wagers by the participating players in an accumulation account.

36. A method as claimed in claim 35, wherein a prize pool is established in which the contents are a function of the outcomes of the separate instances of the single-player game.

37. A method as claimed in claim 36, wherein the prize awarded to the at least one winning player is one of (a) the contents of the accumulation account, (b) the contents of the accumulation account less a service fee retained by an operator of the multiplayer gaming system, or (c) the contents of a prize pool, the contents of the accumulation account being retained by the operator of the gaming system to fund the prize pool.

38. A method as claimed in claim 36, wherein the contents of either one of the accumulation account and the prize pool are shared between a plurality of winners when the accumulation facility determines a plurality of winners in the turn of the multiplayer wager game.

39. A method as claimed in claim 32, wherein any instance of the single-player game has a plurality of potential successful results, the plurality of successful results capable of being ranked in order, from least successful to most successful.

40. A method as claimed in claim 39, wherein the at least one winner of a turn of the multiplayer wager game is determined to be a participating player who obtains a highest-ranking successful result in a corresponding turn of a respective instance of the single-player game.

41. A method as claimed in claim 39, wherein the outcome of the turn of the multiplayer wager game is determined to be a tie when two or more participating players obtain a same highest-ranking successful result of the corresponding turn of their respective instances of the single-player game, or when none of the participating players obtains a successful result of the corresponding turn of their respective instances of the single-player game.

42. A method as claimed in claim 41, further comprising the step of accumulating, in each separate turn of the multiplayer wager game, all wagers by the participating players in an accumulation account and wherein the tie is determined as an unfavourable outcome of the turn of the multiplayer wager game and the contents of the accumulation account are carried over to a next turn of the multiplayer wager game.

43. A method as claimed in claim 41 further comprising the step of accumulating, in each separate turn of the multiplayer wager game, all wagers by the participating players in an accumulation account and wherein the tie is determined as a favourable outcome of the turn of the multiplayer wager game and the contents of the accumulation account are shared between the tied players.

44. A method as claimed in claim 42, wherein the contents of the accumulation account are augmented with player wagers from the next turn of the multiplayer wager game in the event of a carry over.

45. A method as claimed in claim 44, wherein the contents of the accumulation account are carried over to a next turn of the multiplayer wager game for a maximum of five consecutive ties.

46. A method as claimed in claim 45, wherein the outcome of a turn of the multiplayer wager game is automatically determined as a favourable outcome upon the occurrence of a sixth consecutive tie.

47. A method as claimed in claim 32, wherein the progress of each instance of the single-player game played by all the participating players is displayed to each participating player.

48. A method as claimed in claim 32, wherein the at least one turn of the single-player game in each separate instance of the single-player game comprising a single turn of the multiplayer wager game are played either sequentially or simultaneously.

49. A method as claimed in claim 35, further comprising the step of accumulating, in each separate turn of the multiplayer wager game, all wagers by the participating players in an accumulation account and wherein each successful result of an instance of the single-player game is associated with a corresponding prize that is independent of the contents of the accumulation account.

50. A method as claimed in claim 49, wherein a prize is awarded to each participating player in the multiplayer wager game when a highest ranking successful result occurs in a turn of an instance of the single-player game of any participating player.

51. A method as claimed in claim 49, wherein any instance of the single-player game has a plurality of potential successful results, the plurality of successful results capable of being in ranked order, from least successful to most successful, and wherein a prize is awarded to each participating player in the multiplayer wager game when any one of three highest-ranking successful results occurs in a turn of an instance of the single-player game of any participating player.

52. A method as claimed in claim 51, wherein the prizes are awarded independently of the contents of the accumulation account.

53. A method as claimed in claim 32, wherein a single turn of the multiplayer wager game comprises a plurality of turns of the single-player game in each separate instance of the single-player game played by each participating player.

54. A method as claimed in claim 53, wherein a point value is associated with each successful result of the single-player game.

55. A method as claimed in claim 54, wherein points associated with any successful result occurring in that player's plurality of turns in that player's instance of the single-player game are accumulated, for each participating player.

56. A method as claimed in claim 55, wherein the winner of the turn of the multiplayer wager game is determined to be the participating player, or participating players, with the greatest accumulated point value.

57. A method as claimed in claim 56, further comprising the step of accumulating, in each separate turn of the multiplayer wager game, all wagers by the participating players in an accumulation account and wherein the winner of the turn of the multiplayer game is awarded the contents of the accumulation account or the contents of the accumulation account less the service fee retained by the operator of the multiplayer gaming system.

58. A method as claimed in claim 53, wherein each participating player is required to decide, prior to commencement of each of the plurality of turns in the single-player game, except the first, whether to continue with the multiplayer wager game by increasing that player's wager, or to withdraw from the turn of the multiplayer game.

59. A method as claimed in claim 58 further comprising the step of accumulating, in each separate turn of the multiplayer wager game, all wagers by the participating players in an accumulation account and wherein the cumulative wagers of all participating players and the cumulative wagers of any player who withdraws from the turn of the multiplayer game are accumulated in the accumulation account.

60. A method of operation of a multiplayer gaming system, comprising the steps of:

providing computer instructions to a plurality of gaming workstations enabling each one of a plurality of players using such workstations to participate in a multiplayer wager game by playing a separate instance of a same single-player game having a plurality of possible results;

the instructions further enabling each participating player to place a wager on an outcome of the multiplayer wager game and transmit such wager to a gaming server; and using an administration facility associated with the gaming server to determine an outcome of the multiplayer wager game as a function of the combined results of the separate instances of the single-player game, the outcome of the multiplayer wager game being either a favourable outcome if at least one participating player is determined as being a winner of the multiplayer wager game, or an unfavourable outcome in which none of the participating players is determined as being a winner;

accumulating, in each separate turn of the multiplayer wager game, all wagers by the participating players in an accumulation account and wherein each successful result of an instance of the single-player game is associated with a corresponding prize that is independent of the contents of the accumulation account;

wherein any instance of the single-player game has a plurality of potential successful results, the plurality of successful results capable of being in ranked order, from least successful to most successful, and wherein a prize is awarded to each participating player in the multiplayer wager game when any one of three highest-ranking successful results occurs in a turn of an instance of the single player game of any participating player; and wherein the single-player game has a bonus result, the occurrence of the bonus result in any instance of the single-player game enabling any one of:

(i) participation by the participating player in whose instance of the single-player game the bonus result occurred, in the next turn of the multiplayer wager game without requiring a wager, (ii) payment, by the operator of the multiplayer gaming system, of a wager on the next turn of the multiplayer wager game, on behalf of the participating player in whose instance of the single player game the bonus result occurred, and (iii) an award of a monetary prize by the operator of the multiplayer gaming system to the participating player in whose instance of the single-player game the bonus result occurred.

* * * * *